US009096063B2

(12) United States Patent
Kubota et al.

(10) Patent No.: US 9,096,063 B2
(45) Date of Patent: Aug. 4, 2015

(54) LIQUID EJECTION HEAD AND METHOD OF MANUFACTURING SAME

(71) Applicant: CANON KABUSHIKI KAISHA, Tokyo (JP)

(72) Inventors: Masahiko Kubota, Tokyo (JP); Ken Tsuchii, Sagamihara (JP); Masataka Sakurai, Kawasaki (JP); Yoshiyuki Nakagawa, Kawasaki (JP); Akiko Saito, Tokyo (JP); Shinji Kishikawa, Tokyo (JP); Ryoji Kanri, Zushi (JP); Atsunori Terasaki, Kawasaki (JP); Akihiko Okano, Fujisawa (JP); Atsushi Hiramoto, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/746,695

(22) Filed: Jan. 22, 2013

(65) Prior Publication Data

US 2013/0187987 A1 Jul. 25, 2013

(30) Foreign Application Priority Data

Jan. 24, 2012 (JP) ..... 2012-011857

(51) Int. Cl.
*B41J 2/14* (2006.01)
*B41J 2/16* (2006.01)

(52) U.S. Cl.
CPC *B41J 2/1628* (2013.01); *B41J 2/14* (2013.01); *B41J 2/14145* (2013.01); *B41J 2/1603* (2013.01); *B41J 2/1623* (2013.01); *B41J 2/1629* (2013.01); *B41J 2/1631* (2013.01); *B41J 2/1632* (2013.01); *B41J 2/1635* (2013.01); *B41J 2/1639* (2013.01); *B41J 2002/14467* (2013.01)

(58) Field of Classification Search
CPC ..... B41J 2/1433; B41J 2/1628; B41J 2/1631; B41J 2/162; B41J 2/1623; B41J 2/1629; B41J 2/1632; B41J 2/1642
USPC ..... 347/47; 216/27
See application file for complete search history.

(56) References Cited

U.S. PATENT DOCUMENTS

| | | | |
|---|---|---|---|
| 6,508,946 | B1 | 1/2003 | Murakami |
| 6,534,247 | B2 | 3/2003 | Milligan |

(Continued)

FOREIGN PATENT DOCUMENTS

| | | | |
|---|---|---|---|
| CN | 1903578 | A | 1/2007 |
| CN | 101746143 | A | 6/2010 |
| CN | 101797842 | A | 8/2010 |
| CN | 102211458 | A | 10/2011 |
| CN | 102218921 | A | 10/2011 |
| JP | 2000-326515 | A | 11/2000 |
| JP | 3143307 | B2 | 3/2001 |
| JP | 2006-213002 | A | 8/2006 |
| JP | 2007-290203 | A | 11/2007 |
| JP | 2008-260152 | A | 10/2008 |
| JP | 2009-096036 | A | 5/2009 |
| JP | 2009-137155 | A | 6/2009 |
| JP | 2010-201921 | A | 9/2010 |

OTHER PUBLICATIONS

Wikipedia Article: "Deep reactive-ion etching", Apr. 24, 2013, paragraph 2.*

*Primary Examiner* — Lisa M Solomon
(74) *Attorney, Agent, or Firm* — Canon USA Inc IP Division

(57) ABSTRACT

A method of manufacturing a liquid ejection head includes the steps of (1) forming a recess in a second surface of a substrate to form a common supply port, (2) forming an etching mask, which specifies opening positions of independent supply ports, on a bottom surface of the common supply port, and (3) performing ion etching using plasma with the etching mask employed as a mask, thereby forming the independent supply ports. The etching mask has an opening pattern formed therein such that respective distances from an ejection energy generation element to openings of two independent supply ports adjacent to the ejection energy generation element on the first surface side of the substrate are equal to each other.

4 Claims, 16 Drawing Sheets

(56) References Cited

U.S. PATENT DOCUMENTS

| | | | | |
|---|---|---|---|---|
| 8,623,674 | B2 * | 1/2014 | Uyama | 438/21 |
| 2002/0180840 | A1 | 12/2002 | Matsumoto | |
| 2002/0191054 | A1 | 12/2002 | Liu | |
| 2007/0064060 | A1 | 3/2007 | Gu | |
| 2009/0095708 | A1 | 4/2009 | Kubota | |
| 2010/0149260 | A1 | 6/2010 | Okano | |
| 2011/0287562 | A1 | 11/2011 | Kato | |

* cited by examiner

LIQUID EJECTION HEAD AND METHOD OF MANUFACTURING SAME

BACKGROUND OF THE INVENTION

1. Field of the Invention

The present invention relates to a liquid ejection head for ejecting a liquid.

2. Description of the Related Art

In an ink jet recording apparatus, information is recorded on a recording medium by ejecting ink from a plurality of fine nozzles of a recording head in accordance with a recording signal. The ink jet recording apparatus is generally and widely employed because of having advantages such as high-speed recording, high resolution, high image quality, and low noise.

A recording head used in the ink jet recording apparatus is, for example, of the ink jet type recording an image with utilization of thermal energy. In the recording head of the ink jet type, information is recorded by supplying a current to a recording element to heat ink such that the ink is ejected through an ejection orifice under pressure produced upon generation of bubbles. The ink ejected through the ejection orifice is caused to fly in a direction perpendicular to a principal surface of a recording element substrate and to land at a desired position on a recording medium. As a result, the recording with high image quality and high definition is realized.

Japanese Patent Laid-Open No. 2010-201921 describes an ink jet recording head in which pressure chambers for ejecting ink and ink supply ports are adjacently arrayed in a direction in which nozzles are arrayed. FIG. 2 of Japanese Patent Laid-Open No. 2010-201921 is an enlarged view of a nozzle array. A plurality of electrothermal transducers 6 and a plurality of ink supply ports 2A are alternately arrayed in the nozzle array direction. FIG. 3 of Japanese Patent Laid-Open No. 2010-201921 is a sectional view taken along a line III-III in FIG. 2. An ejection orifice 7 is formed in an orifice plate 3 at a position opposed to each of the electrothermal transducers 6. In FIGS. 2 and 3 of Japanese Patent Laid-Open No. 2010-201921, a pressure chamber R is formed between the electrothermal transducer 6 and the orifice plate 3, and the ink supply port 2A is formed adjacent to the pressure chamber. Because the ink supply port having an opening of a larger size than the electrothermal transducer is formed near the pressure chamber, flow resistance can be reduced when the ink is refilled into the pressure chamber. As a result, high-speed printing can be performed by increasing an ink ejection frequency. Furthermore, with the arrangement that the ink supply port having the opening width set described above is arranged adjacent to the pressure chamber in the array direction of the electrothermal transducers (heating resistors), the ink supply port can effectively absorb pressure in the pressure chamber, thus reducing the so-called crosstalk between the adjacent the pressure chambers.

As a method of forming the ink supply port, which has the predetermined size, near the pressure chamber with high accuracy, U.S. Pat. No. 6,534,247 describes a two-step etching process performed on a silicon substrate. According to a method of manufacturing an ink jet recording head, described in U.S. Pat. No. 6,534,247 with reference to FIGS. 5a to 6c, an independent supply port (called "ink feed channel" in the U.S. patent) is first formed from a front surface of the substrate by, e.g., dry etching. Next, a recess is formed by performing wet etching, as first etching, on the silicon substrate, thus forming a liquid chamber (FIG. 5b of U.S. Pat. No. 6,534,247). Next, a slit-shaped pattern is formed in the bottom surface of the recess, and second etching is performed on the bottom surface of the recess along the slit-shaped pattern by silicon dry etching. As a result, the recess is communicated with the independent supply port, which has been formed in advance, whereby the ink jet recording head is completed (FIG. 6b of U.S. Pat. No. 6,534,247). Thus, according to the method of manufacturing an ink jet recording head, described in U.S. Pat. No. 6,534,247, the independent supply port having the same size as a heater size is formed from the front surface of the substrate. A tilting phenomenon (i.e., a deviation in directionality) due to distortion of a plasma sheath does not occur. Moreover, in the event of the distortion of the plasma sheath when the slit-shaped pattern is formed from the rear side of the substrate, ejection characteristics of the ink jet recording head are not affected because it is just requited to establish the communication between the recess and the independent supply port. For that reason, U.S. Pat. No. 6,534,247 describes neither the influence of a plasma molding effect, nor the distortion of the plasma sheath.

SUMMARY OF THE INVENTION

An embodiment of the present invention provides a method of manufacturing a liquid ejection head comprising a substrate including, in a first surface thereof, a plurality of ejection energy generation elements configured to generate energy for ejecting a liquid, and an orifice plate disposed on a first surface side of the substrate to form ejection orifices through which the liquid is ejected, and to define liquid flow passages communicating with the ejection orifices, the substrate including a recess-shaped common supply port formed in a second surface thereof on an opposite side to the first surface, and a plurality of independent supply ports penetrating from a bottom surface of the common supply port to the first surface and communicating with the liquid flow passages, the ejection orifices being disposed above the ejection energy generation elements, two of the independent supply ports being disposed adjacent to each of the ejection energy generation elements for supply of the liquid to the relevant ejection energy generation element with the relevant ejection energy generation element disposed between the two independent supply ports, the method including the steps of: (1) forming a recess in the second surface of the substrate to form the common supply port, (2) forming an etching mask, which specifies opening positions of the independent supply ports, on the bottom surface of the common supply port, and (3) performing ion etching using plasma with the etching mask employed as a mask, thereby forming the independent supply ports, wherein the etching mask has an opening pattern formed therein such that respective distances from the ejection energy generation element to openings of the two independent supply ports adjacent to the ejection energy generation element on the first surface side are equal to each other.

Another embodiment of the present invention provides a liquid ejection head including a substrate including, in a first surface thereof, a plurality of ejection energy generation elements configured to generate energy for ejecting a liquid, and an orifice plate disposed on a first surface side of the substrate to form ejection orifices through which the liquid is ejected, and to define liquid flow passages communicating with the ejection orifices, wherein the substrate includes a recess-shaped common supply port formed in a second surface thereof on an opposite side to the first surface, and a plurality of independent supply ports penetrating from a bottom surface of the common supply port to the first surface and communicating with the liquid flow passages, the ejection orifices are disposed above the ejection energy generation elements, two of the independent supply ports are disposed adjacent to each of the ejection energy generation elements for supply of the liquid to the relevant ejection energy generation element with the relevant ejection energy generation element disposed between the two independent supply ports, and respective distances from the ejection energy generation element to openings of the two independent supply ports adjacent to the ejection energy generation element on the first surface side are equal to each other.

Further features of the present invention will become apparent from the following description of exemplary embodiments with reference to the attached drawings.

DESCRIPTION OF THE EMBODIMENTS

Figure 1A:
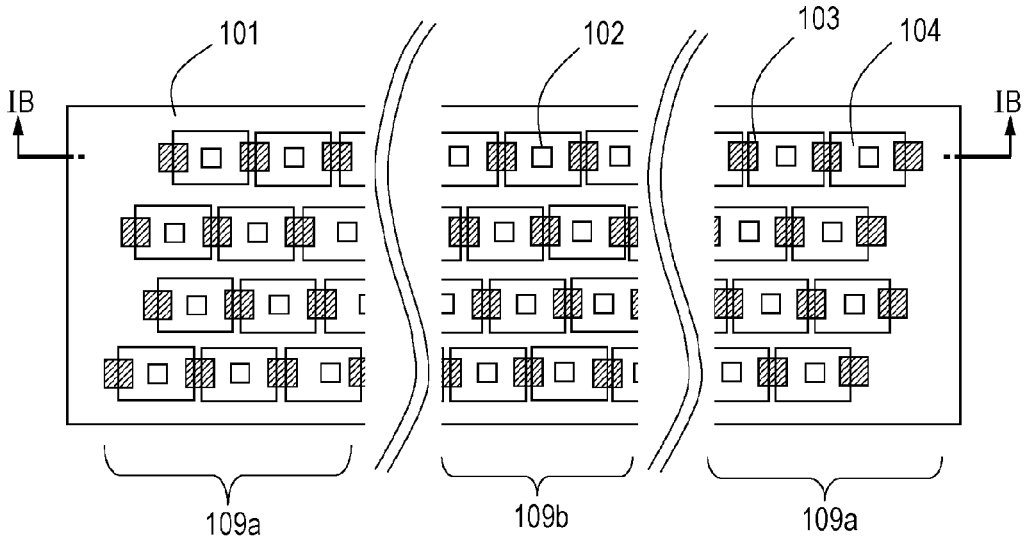
FIGS. 1A and 1B are respectively a schematic plan view and a schematic sectional view to explain an example of structure of an ink jet recording head according to a first embodiment.

It is generally known that, when a recess (opening) is formed in a flat semiconductor substrate (silicon wafer) by silicon dry etching, a positive space charge layer having a sheath length, expressed by the following formula (3), is uniformly formed on the substrate.

$$s = \frac{2V_0^{3/4}}{3}\sqrt{\frac{\varepsilon_0}{J_0}}\left(\frac{2e}{m_i}\right)^{1/4} \tag{3}$$

$J_0$: ion current density ($A/m^2$)
$\in_0$: vacuum dielectric constant ($8.85\times10^{-12}$ F/m)
e: elementary charge ($1.60\times10^{-19}$ C)
$m_i$: ion mass (kg)
$V_0$: sheath voltage (V)
s: sheath length (m)

The following reference paper reports influences of a plasma sheath upon a microscale pattern formed on the silicon wafer:

"Shape Development Modeling of Si Deep Etching under Molding by 2-Frequency Capacity-Coupled Plasma" (Fukutaro Hamaoka, Doctoral Thesis of Makabe Laboratory, Faculty of Electrical Engineering at Keio University's Department of Science and Engineering, 2008).

The above reference paper reports in detail the plasma molding effect when a microscale pattern in a patterned shape is deeply formed in a silicon wafer by silicon etching, and change of a sheath distribution at that time. Furthermore, the reference paper discloses a shape prediction method based on the plasma molding effect in silicon deep etching. In addition, the reference paper suggests that the Bosch process etching, including a process of protecting a sidewall, is useful for the silicon deep etching.

However, the above reference paper describes nothing regarding influences of a plasma sheath, which is generated on the surface of a stepped portion including a recess, upon the shape of an independent supply port when the independent supply port is formed by dry etching in a bottom surface of a common supply port that has been formed in the recessed shape. In more detail, the above reference paper states that, in a step of deep-etching the silicon substrate, the distribution of a plasma sheath is changed depending on the shape of the substrate under the processing. Furthermore, the reference paper discusses in detail the effect resulting from such a change in the distribution of a plasma sheath, which affects the processed shape. However, the reference paper does not describe the influence of the distortion of the plasma sheath upon a trench shape to be perpendicularly formed in an initial processing stage, when in a substrate already having a certain stepped shape, a pattern is processed to be arrayed in a bottom surface of the stepped shape.

On the other hand, the inventors have found that, when negatively charged ion flux is accelerated in a plasma sheath region having a positive space charge layer in a step of forming the independent supply port, etching progresses at an angle from a start position of the etching due to an influence of the plasma sheath near the sidewall of the recess. Thus, because, in the bottom surface of the recess in the substrate, silicon etching progresses at an angle from the start position of the silicon etching (see FIG. 6A), an opening of the independent supply port on the front surface side of the substrate is formed at a position deviated from the desired opening position. Such a phenomenon is observed not only in the Bosch process in which silicon etching is repeated after forming a deposition film and then removing the deposition film on a bottom surface of an etched hole in the etching process, and a similar tendency also appears in a non-Bosch process using an ICP (Inductively Coupled Plasma) etcher described below.

In the case where ink is refilled into a pressure chamber from plural ink supply ports, if the opening position of the independent supply port is deviated from the desired position, flow resistances from the individual ink supply ports to the heating resistor are different from each another. As a result, the ink is ejected obliquely relative to a direction, which is perpendicular to a principal surface of the substrate of a recording element, from the pressure chamber including the heating resistor, whereby recording failures, e.g., stripes and irregularities, may occur on a recording medium.

In view of the problem described above, the present invention provides a method of manufacturing a liquid ejection head, which can reduce an inclination of an ejection direction of a liquid, e.g., ink.

Embodiments of the present invention will be described in detail below. It is to be noted that the present invention is not limited to those embodiments. While the following description is made primarily in connection with an ink jet recording head as an application example of the liquid ejection head according to the embodiment of the present invention, application fields of the present invention are not limited to the ink jet recording head, and the present invention is further applicable to other liquid ejection heads used in fabricating biochips and printing electronic circuits. Another example of the liquid ejection head other than the ink jet recording head is a head used in manufacturing a color filter.

Figure 8A:
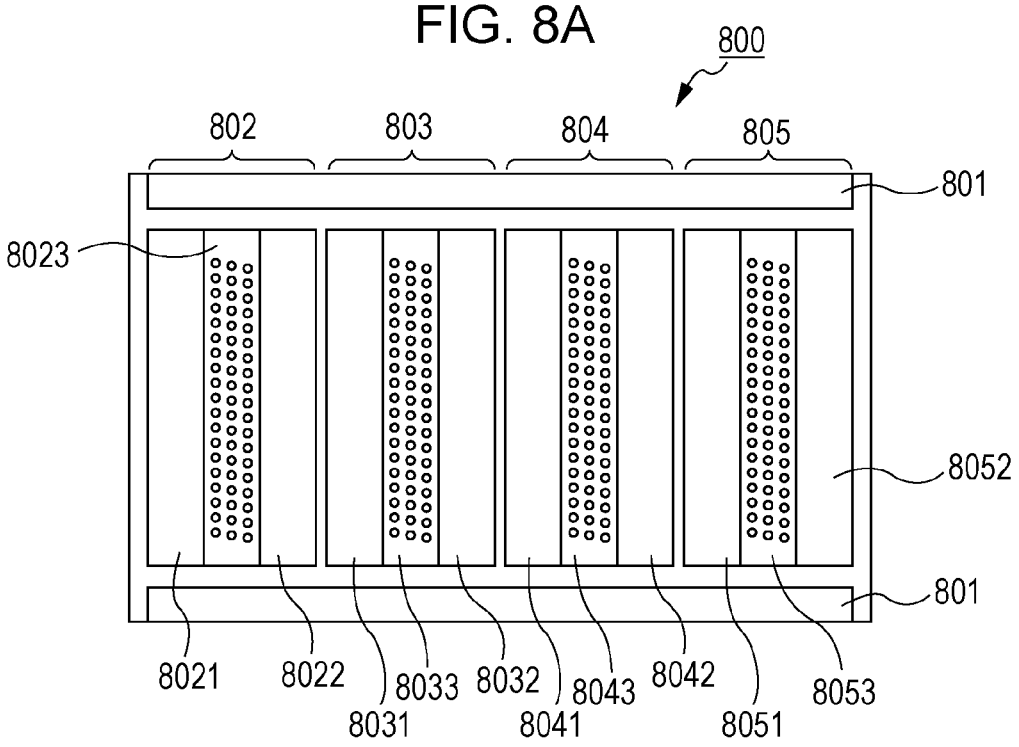
FIGS. 8A and 8B are respectively a schematic plan view and a schematic bottom view to explain an example of structure of an ink jet recording head according to an embodiment.
Figure 8B:
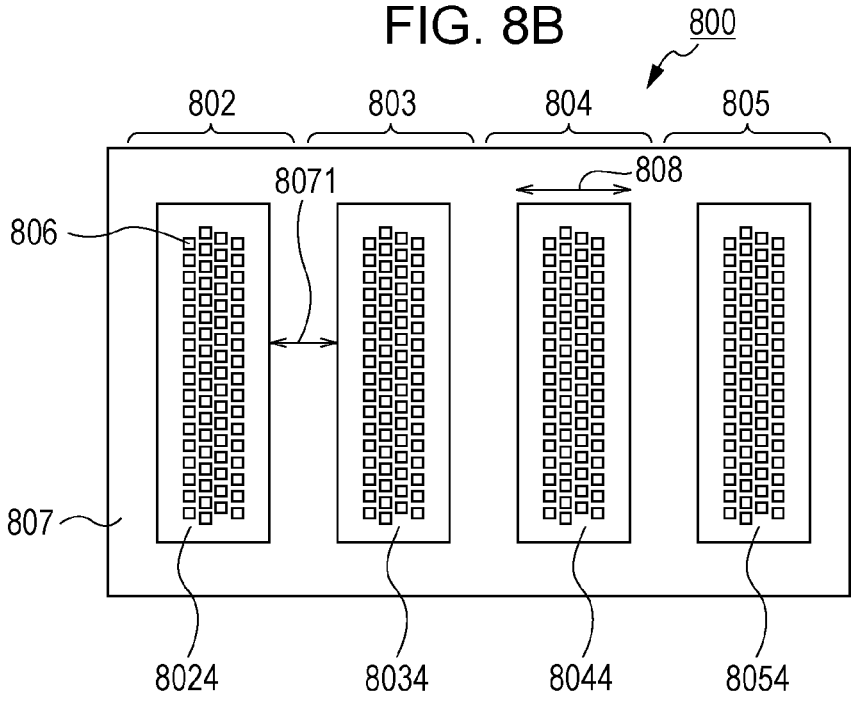

FIGS. 8A and 8B are schematic views illustrating, in the simplified form, a chip of an ink jet recording head that has been cut out from a silicon wafer by dicing. An ink jet recording head 800, illustrated in the schematic plan view of FIG. 8A, includes an array of nozzles from which inks of four colors (Black, Cyan, Magenta, and Yellow) are ejected to fry. The ink jet recording head 800 further includes heaters (called also "heating resistors") as ejection energy generation elements. The ink jet recording head 800 includes, on the same substrate, a plurality of heater arrays and functional element regions (8021, 8022, 8031, 8032, 8041, 8042, 8051 and 8052) for separately driving individual heaters. Nozzle regions (8023, 8033, 8043 and 8053) from which the inks are ejected to fly are disposed in a substrate. Furthermore, an electrode pad region 801 for supplying power and driving signals to the heaters and functional elements from the outside is disposed at an end of the substrate. The length of the nozzle region and the number of nozzles are selected in consideration of resolution in a direction of the heater array disposed on the substrate and a printing width by one-pass printing.

FIG. 8B is a schematic bottom view of the ink jet recording head 800 illustrated in FIG. 8A when viewed from the rear side of the substrate. In the ink jet recording head 800 of this embodiment, common supply ports (8024, 8034, 8044 and 8054) are disposed in regions except for bonding regions 807, which are bonded to a supporting member (not illustrated) and which has a bonding width 8071. Independent supply ports 806 communicating with nozzles disposed in a front surface of the substrate are formed in bottom surfaces of the common supply ports. The ink jet recording head is bonded to the supporting member (not illustrated) with an adhesive applied to the bonding regions 807.

In order to obtain sufficient bonding strength and to prevent mixing of the ink colors, the bonding width 8071 is to be 0.5 mm or more. Furthermore, an opening width W 808 of each common supply port in a widthwise direction thereof is to be 1.5 mm or less. That setting contributes to reducing a chip size of the ink jet recording head and to increasing the number of chips cut out from one silicon wafer. Accordingly, the cost of the ink jet recording head can be reduced. Furthermore, when the opening width W 808 of the common supply port in the widthwise direction thereof is 0.32 mm or less and a ratio of the opening width W 808 to an opening depth (i.e., an aspect ratio) is 0.64 or less, distortion of a plasma sheath produced on the substrate surface is not distributed up to the vicinity of the bottom surface of the common supply port. Accordingly, the occurrence of tilting phenomenon (inclination) of the independent supply port is suppressed. Moreover, when the opening width W 808 of the common supply port is 0.32 mm or more, resolution of the nozzles, which can be arranged in the nozzle region for each color illustrated in FIG. 8A, is increased. As a result, an ink jet recording head having high image quality and operating at a high speed can be provided more easily.

Figure 9:
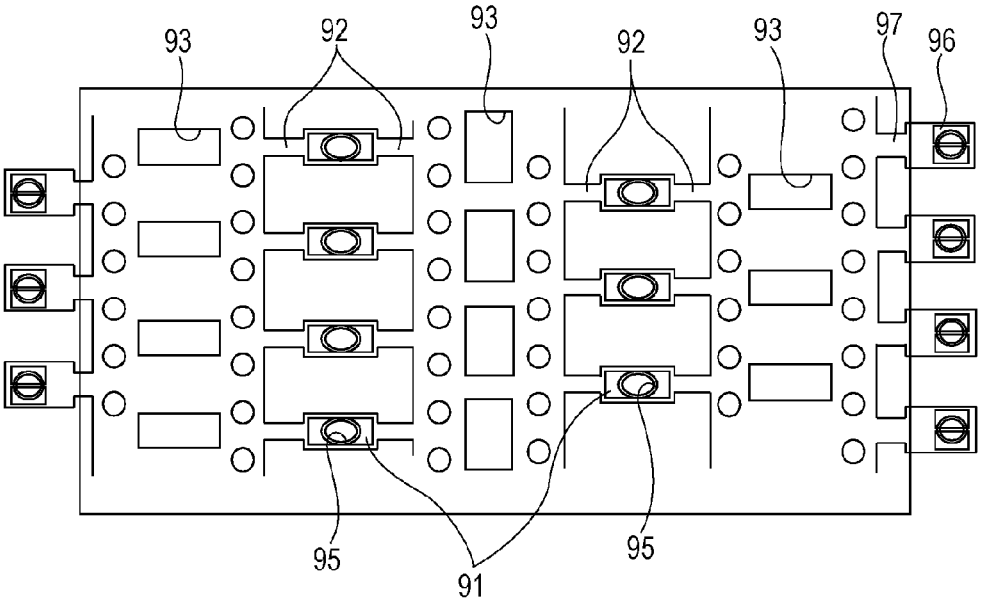
FIG. 9 is a schematic plan view to explain an example of structure of the ink jet recording head according to the embodiment.

FIG. 9 is a schematic plan view illustrating an example of structure of the ink jet recording head according to the embodiment. In FIG. 9, first heaters 91 are disposed as the ejection energy generation elements. Second heaters 96 are disposed in an outer peripheral portion of the nozzle region. For each of the first heaters 91, as illustrated in FIG. 9, two first liquid flow passages 92 are formed in symmetrical relation to the first heater 91. In other words, FIG. 9 is an enlarged schematic view when looking, from above, the nozzle arrangement for one color in the ink jet recording head according to the embodiment. The first heaters 91 are arranged between independent supply ports 93 arranged at a center and other independent supply ports 93 arranged on both sides of the formers. Distances from each first heater 91 to two independent supply ports adjacent to the first heater 91 are equal to each other. The first liquid flow passages 92 disposed on both sides of the first heater 91 are to be symmetrical with respect to the first heater 91. With such an arrangement, the ink is supplied to the first heater 91 from the independent supply ports 93 on both the sides through the two first liquid flow passages 92 that are symmetrical with respect to the first heater 91. The independent supply ports 93 are communicated with the corresponding common supply ports. One second liquid flow passage 97 for supplying the ink to the second heater 96 is disposed for the second heater 96. In the embodiment in which the second heaters are disposed in the outer peripheral portion of the nozzle region as illustrated in FIG. 9, the first heater 91 provided with the two symmetrical first liquid flow passages 92 corresponds to the ejection energy element in the present invention.

In this specification, the expression "equal" implies that a difference between two distances, for example, is within 1.0 μm, advantageously within 0.5 μm, more advantageously within 0.3 μm, and even more advantageously within 0.1 μm.

A method of manufacturing the ink jet recording head according to the embodiment will be described below with reference to FIGS. 10A, 10B, 10C, 10D, 10E, 10F, 10G, and 10H, which are sectional views illustrating successive steps.

Figure 10A:
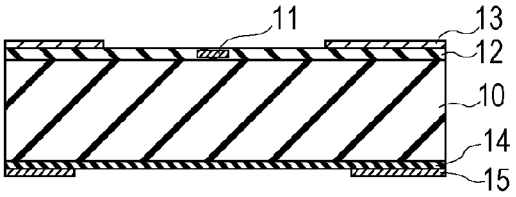
FIGS. 10A, 10B, 10C, 10D, 10E, 10F, 10G, and 10H are sectional views to explain an example of steps for manufacturing the ink jet recording apparatus head according to the embodiment.

First, as illustrated in FIG. 10A, a substrate 10 including a heater 11 as the ejection energy generation element is prepared. A protective layer 12 and an adhesion improving layer 13 are disposed on a front surface (first surface side) of the substrate 10. An oxide film 14 is disposed on a rear surface (i.e., a surface on the side opposite to the first surface; called also a second surface) of the substrate 10. A patterning mask 15 is disposed on the oxide film 14.

For example, a silicon substrate may be used as the substrate 10. The oxide film 14 is, e.g., a silicon oxide film. The silicon oxide film may be formed by oxidizing the silicon substrate.

For example, a silicon oxide film, a silicon nitride film, or a silicon oxynitride film may be used as the protective film 12.

For example, HIMAL (trade name, made by Hitachi Chemical Co., Ltd.) may be used as the adhesion improving layer 13. The adhesion improving layer 13 may be formed by patterning a film of HIMAL by photolithography. The patterning mask 15 may also be formed using HIMAL, for example.

Figure 10B:
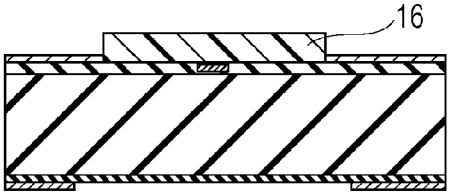

Next, as illustrated in FIG. 10B, a flow passage mold member 16 serving as a mold for forming an ink flow passage (liquid flow passage) is formed on the substrate 10.

The flow passage mold member 16 may be formed using, e.g., a positive resist. An example of the positive resist is, e.g., a resist containing PMIPK. A coating-type resist containing PMIPK as a main component is commercially available, for example, as ODUR-1010 (trade name) from TOKYO OHKA KOGYO Co., Ltd. A coating of such a resist may be formed on the substrate by a universal spin-coating process. The pattern illustrated in FIG. 10B may be formed, for example, by exposing a coating of the resist containing PMIPK to exposure light that has a wavelength of 230 to 350 nm, and then developing the exposed coating.

Figure 10C:
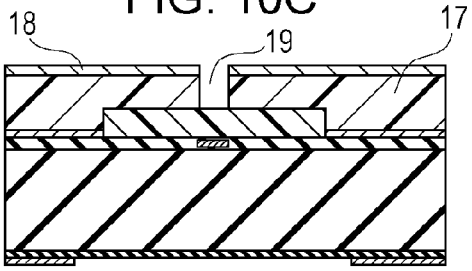

Next, as illustrated in FIG. 10C, a coating resin layer 17 is formed to cover the flow passage mold member 16. In FIG. 10C, a water-repellent coating 18 is disposed on the coating resin layer 17.

For example, a resist material may be used as the coating resin layer 17. More specifically, a negative resist is to be used.

The resist material used for the coating resin layer 17 may be, e.g., a photosensitive material, described in Japanese Patent No. 3143307, which contains an epoxy resin as a main constituent material. That photosensitive material is advantageously prevented from becoming compatible with PMIPK by dissolving the photosensitive material in an aromatic solvent, e.g., xylene, and by coating it. The coated resist material is exposed. In general, because a negative resist is used as the resist material for the coating resin layer 17, a photomask (not illustrated) blocking off light is coated on a portion that becomes an ejection orifice 19.

When the water-repellent coating 18 is formed on the coating resin layer 17, the water-repellent coating 18 may be formed, as described in, e.g., Japanese Patent Laid-Open No. 2000-326515, by arranging a photosensitive water-repellent material, and by exposing and developing the photosensitive water-repellent material together with the resist material of the coating resin layer 17. For example, a laminated material may be used as the photosensitive water-repellent material. In general, because the resist material used for the coating resin layer 17 has a negative characteristic, the exposure is performed by coating a photomask (not illustrated) blocking off light on the portion that becomes the ejection orifice 19. The ejection orifice 19 is formed by developing the resist material of the coating resin layer 17 and the photosensitive water-repellent material after the exposure. The development is to be performed using an aromatic solvent, e.g., xylene.

Figure 10D:
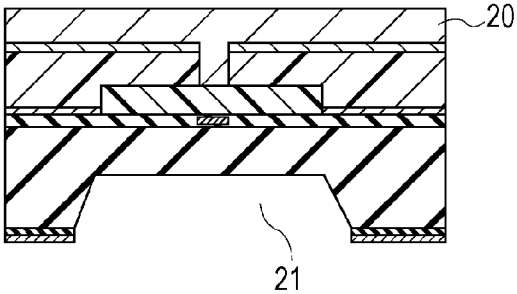

Next, as illustrated in FIG. 10D, a material protective layer 20 is formed on the coating resin layer 17 and the water-repellent coating 18 to protect those layers from an etchant. Thereafter, a common supply port 21 is formed by etching the substrate from the rear surface side of the substrate.

For example, cyclized isoprene may be used as the material protective layer 20. Cyclized isoprene is commercially available, for example, as OBC (trade name) from TOKYO OHKA KOGYO Co., Ltd.

When the silicon substrate is etched, an alkaline solution, e.g., a 22-wt % solution of tetramethylammonium hydride (TMAH), may be used as the etchant. The common supply port 21 may be formed, for example, by immersing the substrate in the 22-wt % solution of TMAH at 83° C. for 12 hours.

A distance from the rear surface (second surface) of the substrate 10 to a flat surface (bottom surface) of the common supply port 21 is, e.g., 500 μm. A thickness of the substrate is, e.g., 625 μm (in the case using the CZ substrate made by Mitsubishi Materials Corporation), and the substrate has a 6-inch size (ϕ150 mm).

Figure 10E:
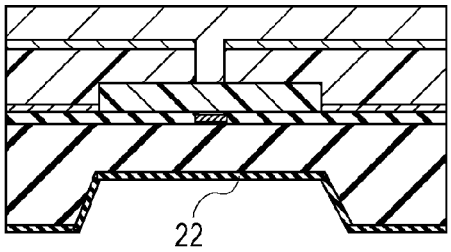

Next, as illustrated in FIG. 10E, after removing the patterning mask 15 and the oxide film 14 both formed on the rear surface of the substrate, a material of an etching mask used in forming the independent supply port (i.e., an etching mask material) 22 is coated on the bottom surface of the common supply port 21.

The etching mask material 22 may be coated, for example, by employing a spray device (EVG150 made by EVG). The etching mask material 22 may be, e.g., a photosensitive material (AZP4620 (made by AZ Electronic Materials), OFPR (made by TOKYO OHKA KOGYO Co., Ltd.), or BCB (made by Dow Corning)). A film thickness of the etching mask material 22 is, e.g., 10 μm.

Figure 10F:
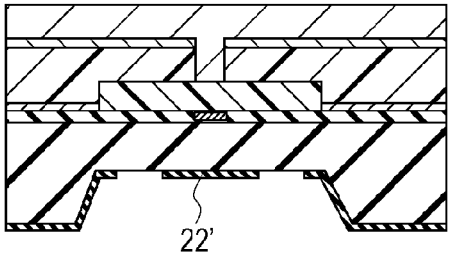

Next as illustrated in FIG. 10F, an etching mask 22' is formed by patterning the film of the etching mask material 22.

The film of the etching mask material 22 is patterned, for example, through exposure and development. The etching mask 22' has an opening pattern corresponding to the independent supply ports. In other words, the etching mask 22' defines opening positions of the independent supply ports, and the opening pattern of the etching mask 22' corresponds to an opening pattern of the independent supply ports on the rear surface side of the substrate.

In this embodiment, the opening pattern of the etching mask 22' is formed such that distances from the ejection energy generation element to respective openings of two independent supply ports adjacent to the ejection energy generation element on the first surface side are equal to each other.

An exposure apparatus may be of the projection type or the proximity type without problems on condition that the desired patterning can be obtained with the exposure apparatus.

Figure 10G:
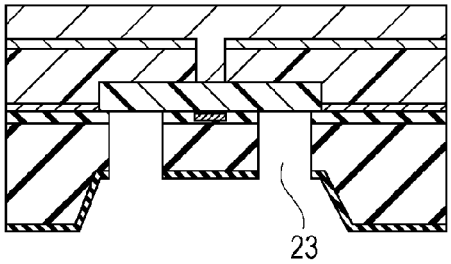

Next, as illustrated in FIG. 10G, an opening penetrating from the bottom surface of the common supply port 21 to the front surface of the substrate is formed by ion etching using plasma with the etching mask 22' employed as a mask, whereby the independent supply ports 23 are formed.

The above dry etching may be performed, for example, by first removing a silicon layer on the silicon substrate, and then successively removing the P—SiO film and the P—SiN film, which are membranes.

Figure 10H:
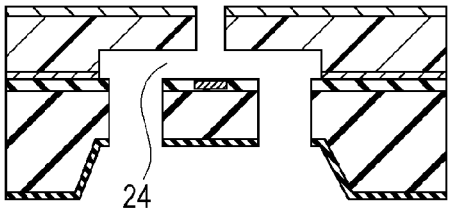

Next, as illustrated in FIG. 10H, the material protective layer 20 is removed, and the flow passage mold member 16 is further removed. A space formed after removing the flow passage mold member 16 provides a pair of two liquid flow passages 24.

For example, the positive resist layer forming the flow passage mold member 16 is decomposed by immersing the substrate in xylene to remove the OBC, and then by exposing the entire surface of the substrate to light. The material of the positive resist is decomposed to lower-molecular compounds by illuminating it with light of wavelength not longer than 330 nm, for example, and those lower-molecular compounds are easily removed by a solvent. After the decomposition, the positive resist layer is removed using the solvent.

With the above-described step, the pair of two liquid flow passages 24 communicating with the ejection orifice 19 is formed as illustrated in the sectional view of FIG. 10H.

The above-mentioned two liquid flow passages communicating with one heater 11 are to be symmetrical with respect to the heater 11. Stated another way, as illustrated in, e.g., FIGS. 1B and 3B described later, in a section taken along a plane that passes a center of an ejection energy generation element and respective centers of two independent supply ports adjacent to the ejection energy generation element, and that is perpendicular to a surface direction of the substrate, one liquid flow passage extending from the ejection energy generation element to one of the two independent supply ports and the other liquid flow passage extending from the ejection energy generation element to the other independent supply port are to be symmetrical with respect to the ejection energy generation element. The symmetry of the two liquid flow passages with respect to the ejection energy generation element implies that those liquid flow passages are symmetrical in the above-mentioned section with respect to a line passing the center of the ejection energy generation element and being perpendicular to the substrate surface.

The ion etching using plasma, which is performed in the embodiment, will be described in detail below. It is to be noted that the following description is made primarily in connection with the case using an ICP etcher, but the present invention is not limited to such a case.

Figure 6A:
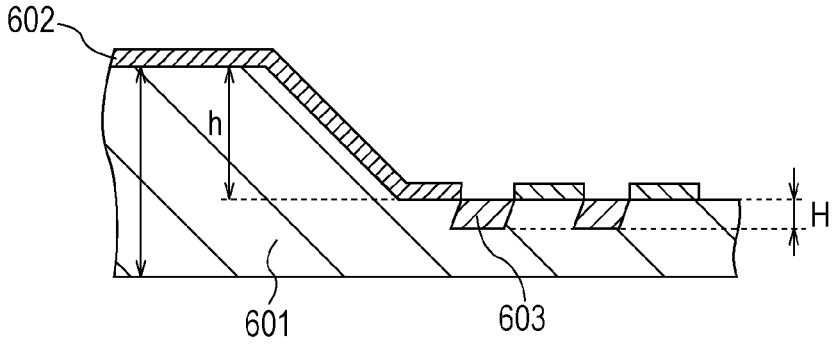
FIGS. 6A, 6B and 6C are each a schematic sectional view of a substrate to explain the embodiment.
Figure 7:
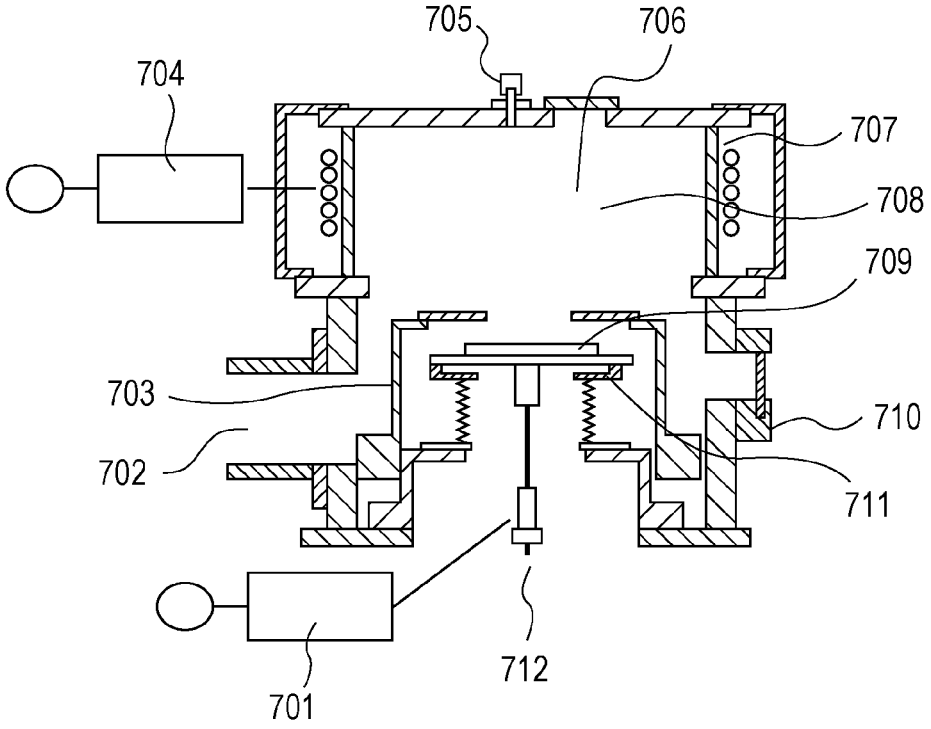
FIG. 7 is a schematic view to explain an example of construction of an ICP etcher.

FIG. 6A illustrates a step of, after forming a common supply port, which has a large step difference, in a rear surface of a conductive substrate, forming the independent supply ports, which penetrate up to a front surface of the substrate, in the common supply port. That step is carried out in many cases using an Inductively Coupled Plasma apparatus (called also an "ICP etcher" hereinafter) illustrated in FIG. 7. The ICP etcher is suitable for etching silicon up to a depth of about 10 μm or more approximately at a normal temperature. In the ICP etcher, as illustrated in FIG. 7, a plasma source including a coil-shaped antenna and a dielectric for insulating the antenna from plasma is employed, and a magnetic field is generated by an RF current flowing through the antenna. The RF magnetic field generates an induced electric field with electromagnetic induction, thereby producing and maintaining the plasma. As illustrated in FIG. 7, the coil-shaped antenna for generating the induced electric field is positioned outside a vacuum vessel with a dielectric window interposed therebetween. Furthermore, the ICP etcher is advantageous in that an etching shape and a selection ratio relative to an underlying material are easily controlled in the ICP etcher because ion flux depending on discharge power and ion energy depending on bias power are controllable independently of each other. Moreover, the ICP etcher has a feature capable of obtaining an electron density as high as $10^{11}$ to $10^{13}$ $cm^{-3}$. The ICP etcher generates plasma having a high electron density and decomposes etching gas with the plasma, thereby generating ions and radicals. The generated ions and radicals are accelerated toward the substrate in a plasma sheath, which is produced over the substrate, thereby etching a material to be etched, e.g., silicon. The ICP etcher can deeply etch the material to be etched, while maintaining perpendicularity.

However, as described above, when the plural independent supply ports are formed in the bottom surface of the recess, which has been formed in the silicon wafer, by employing the ICP etcher, the positive space charge layer (plasma sheath) is distorted due to the influence of the shape of the recess. In more detail, when high-density plasma formed in a plasma chamber by an RF bias power supply disposed in a lower portion of the ICP etcher is moved to a region where the substrate to be processed by the plasma is placed, the plasma sheath is distorted due to the influence of the shape of the recess in the substrate. Such a distortion of the plasma sheath deteriorates the perpendicularity of the independent supply port that is formed in the bottom surface of the common supply port. To examine a detailed distribution of the distortion, the inventors actually measured the electron temperature, the density, and the sheath potential when the plasma was produced in the ICP etcher, by employing the "On-Wafer Monitoring System" developed by Samukawa Laboratory at Tohoku University. The "On-Wafer Monitoring System" is able to perform plasma monitoring in the ICP etcher.

(Reference Paper) Journal of Applied Physics, Vol. 17 (2010), 043302 "Prediction of UV spectra and UV-radiation damage in actual plasma etching processes using on-wafer monitoring technique"

ASE-Pegasus (made by SUMITOMO PRECISION PRODUCTS Co., Ltd.) was used as the ICP etcher. Based on the measured results, the ion orbit and the etching shape necessary for perpendicularly forming the independent supply port were predicted using a plasma analysis simulator. FabMeister-PB (made by Mizuo Information & Research Institute, Inc.) was used as the plasma analysis simulator. The independent supply ports were formed as follows. First, as illustrated in FIG. 6A, a common supply port having a step difference of about 500 μm was formed in a rear surface of a silicon substrate by anisotropic wet etching. Then, an etching mask having an opening pattern corresponding to the independent supply ports was formed on a bottom surface of the common supply port, and etching was performed on the substrate from the rear surface side by employing the ICP etcher.

Figure 6B:
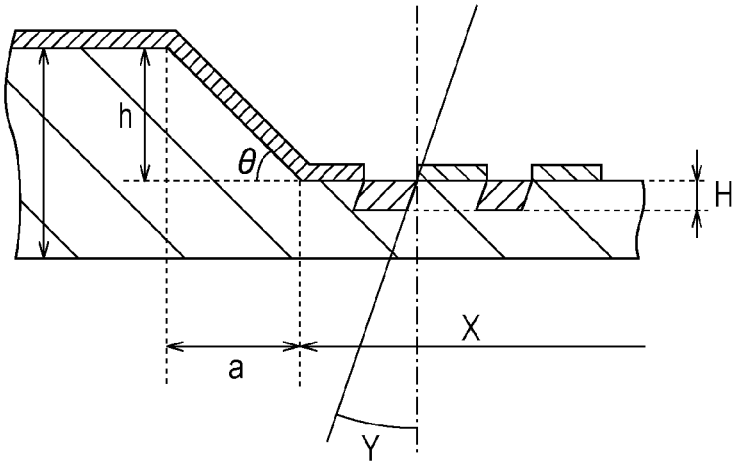
Figure 12:
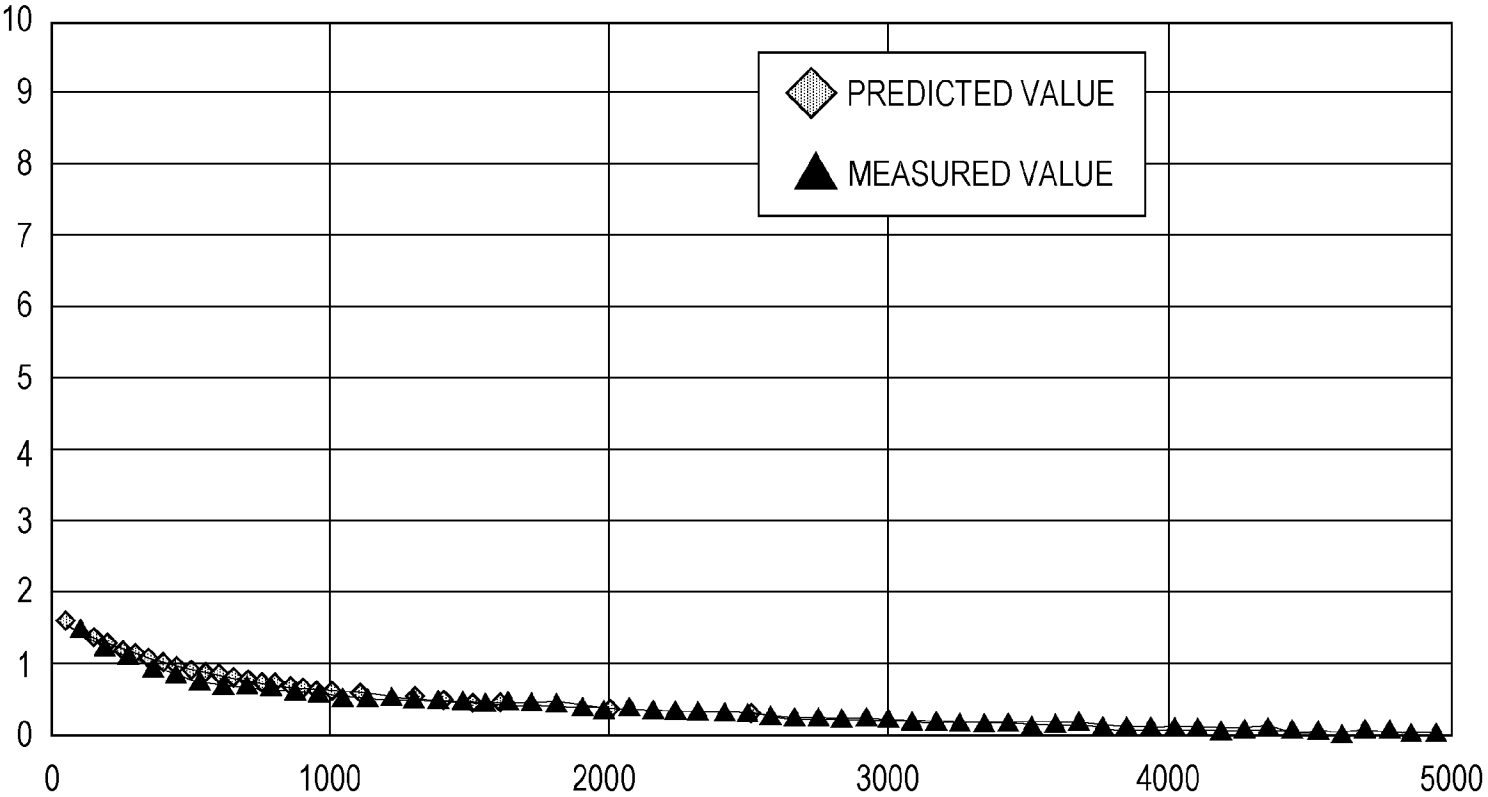
FIG. 12 is a graph depicting predicted values and measured values obtained with the embodiment.

FIG. 12 is a graph depicting predicted values and measured values obtained with the above-described method. It is to be noted that the predicted values and the measured values in the graph of FIG. 12 represent the results obtained with a substrate in the form illustrated in FIG. 6B. As seen from the graph of FIG. 12, the above-described prediction method is able to accurately predict the actual phenomenon.

When, in the step of FIG. 10G, the independent supply ports 23 are formed along the heater array in the common supply port, the plasma sheath is distorted due to the influence of the step difference of the common supply port, whereby the ion orbit of an etching ion generated upon decomposition of etching gas is curved. Therefore, the independent supply ports near the sidewall of the common supply port are etched and formed in shape slightly inclined from a direction perpendicular to the substrate surface. Such an inclination angle is defined as Y (see FIG. 6B). When the common supply port is formed by the anisotropic etching, a distance from an edge of the bottom surface of the common supply port to an opening edge of the common supply port is given by a (=h/tan θ, h: depth of the common supply port) in a direction parallel to the substrate surface.

Figure 6C:
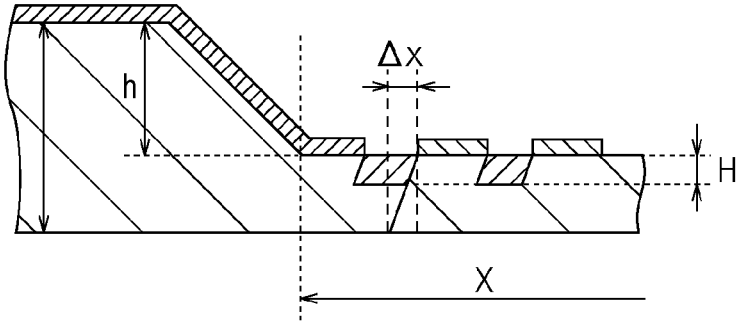

FIG. 6C illustrates a section taken along a plane that passes a region where the independent supply ports are formed, that is perpendicular to the substrate surface, and that is parallel to the widthwise direction of the common supply port. In FIG. 6C, a distance from the edge of the bottom surface of the common supply port to any one of the independent supply ports is defined as X. Specifically, X denotes a distance from the edge of the bottom surface of the common supply port to an edge of the independent supply port on the side nearer to the edge of the bottom surface, or a distance to a center of the independent supply port. Given that a depth of the independent supply port is H, a distance from the rear surface (second surface) of the substrate to an opening bottom end of the independent supply port on the first surface side (i.e., to a bottom surface of the independent supply port) is expressed by (h+H). Furthermore, the following formula (4) is derived from the above-mentioned predicted values.

$$Y=2.0\times10^{-14}\times(X+a)^4-2.0\times10^{-10}\times(X+a)^3+1.0\times10^{-6}\times(X+a)^2-1.8\times10^{-3}\times(X+a)+3.3\times10^{-3}\times h-4.5\times10^{-3} \quad (4)$$

As described above, it is understood that the independent supply port formed in the bottom surface of the common supply port is formed at the inclination angle Y expressed by the above formula (4). The inclination angle Y changes depending on the distance X from the edge of the bottom surface of the common supply port to the independent supply port. Moreover, given that a deviation of the position where the independent supply port communicates with the nozzle (ejection orifice) in the front surface of the substrate is Δx as illustrated in FIG. 6C, Δx is expressed by the following formula (1) on condition that the depth of the independent supply port is H:

$$\Delta x=H\times\mathrm{Tan}\ (\mathrm{RADIANS}(Y)) \quad (1)$$

Thus, the position deviation Δx can be predicted using the formula (1).

Figure 13:
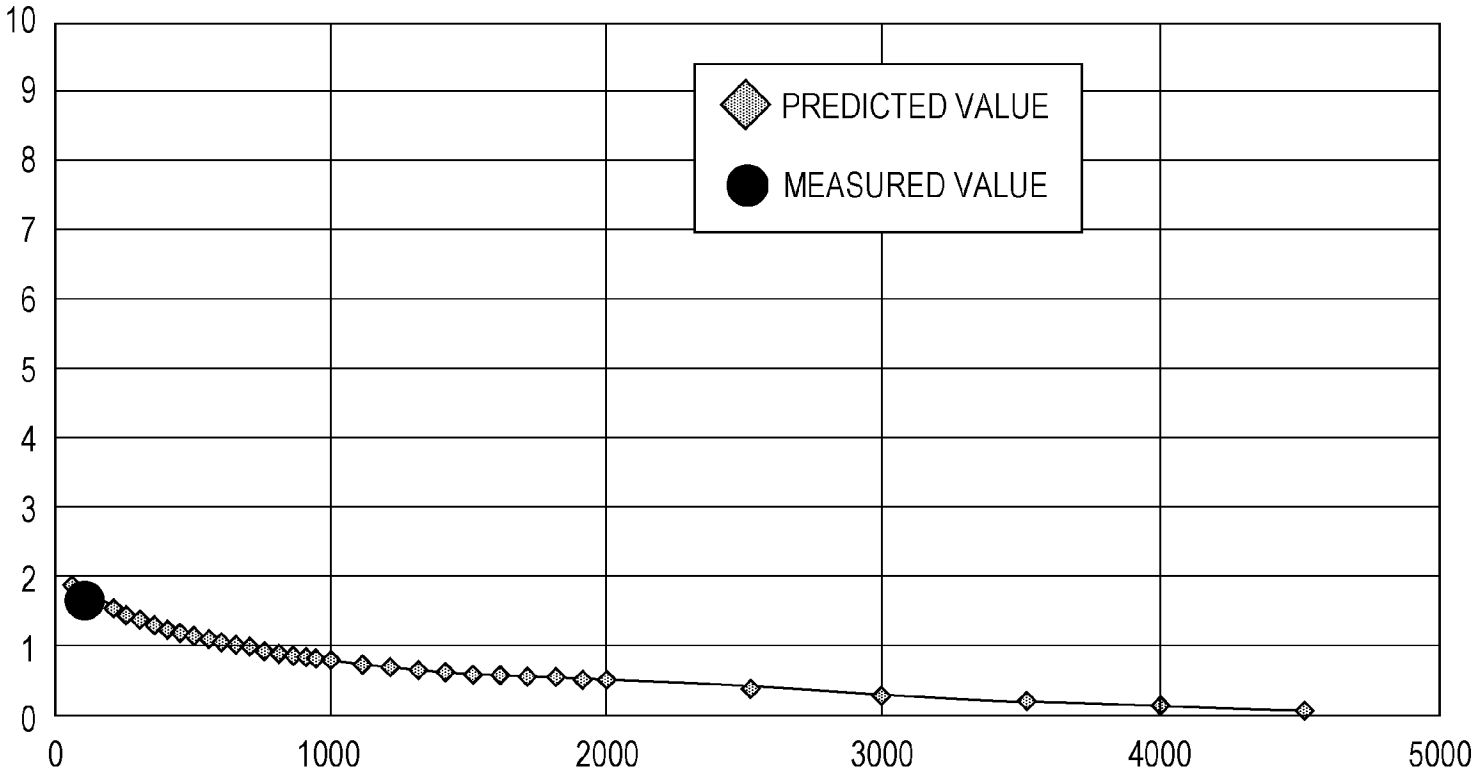
FIG. 13 is a graph depicting predicted values and measured values obtained with the embodiment.

The predicted values depicted in the graph of FIG. 12 represent the results obtained when the depth of the common supply port is 500 μm. FIG. 13 represents the results of the predicted values and the measured values obtained when the depth of the common supply port is 564 μm.

From FIGS. 12 and 13, it is inferred that the distortion of the plasma sheath exhibits a similar tendency if process conditions (such as an RF power value, a process pressure, and a gas flow rate) of the ICP etcher are held constant. Therefore, the inclination angle of each independent supply port can be predicted based on the distance from the edge of the bottom surface of the common supply port. Hence a (tilt) shift (deviation) Δx of the independent supply port can be predicted in advance.

Figure 14:
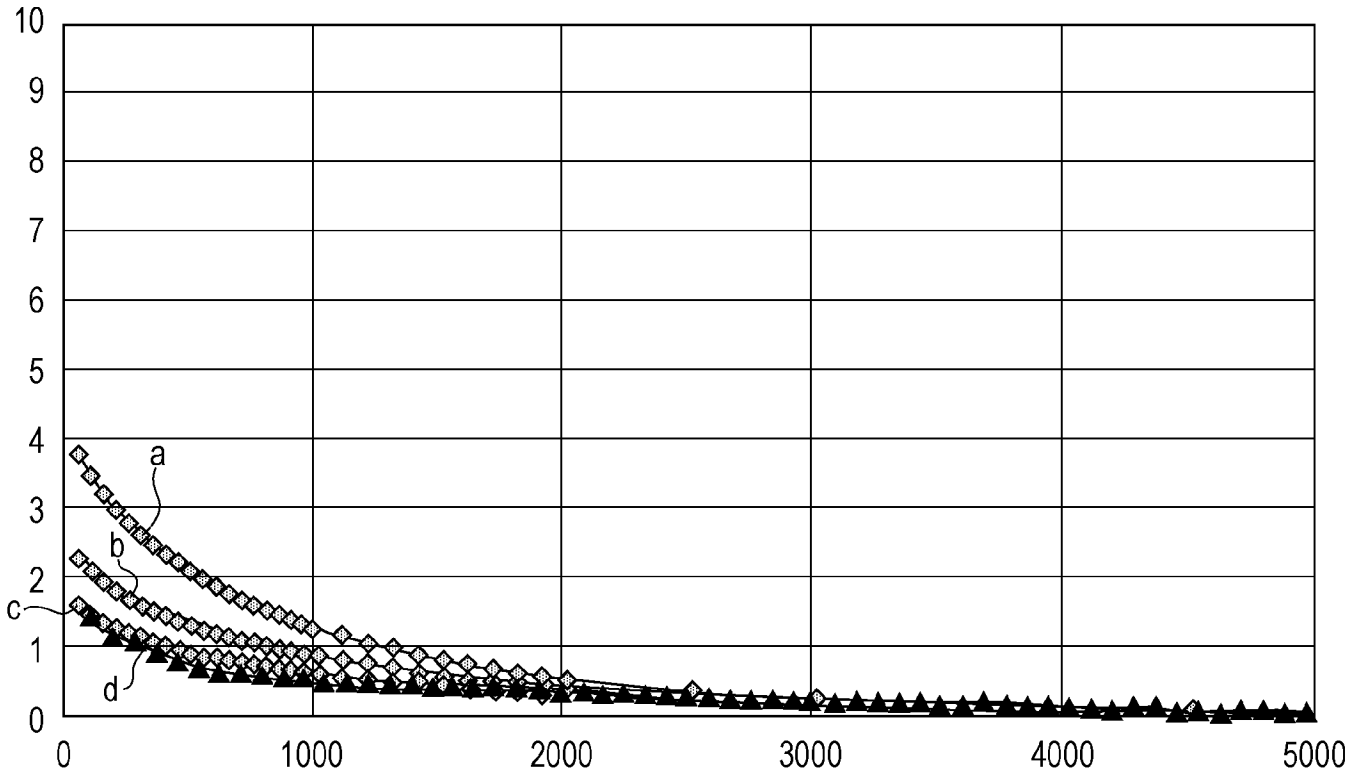
FIG. 14 is a graph depicting predicted values and measured values obtained with the embodiment.
Figure 15:
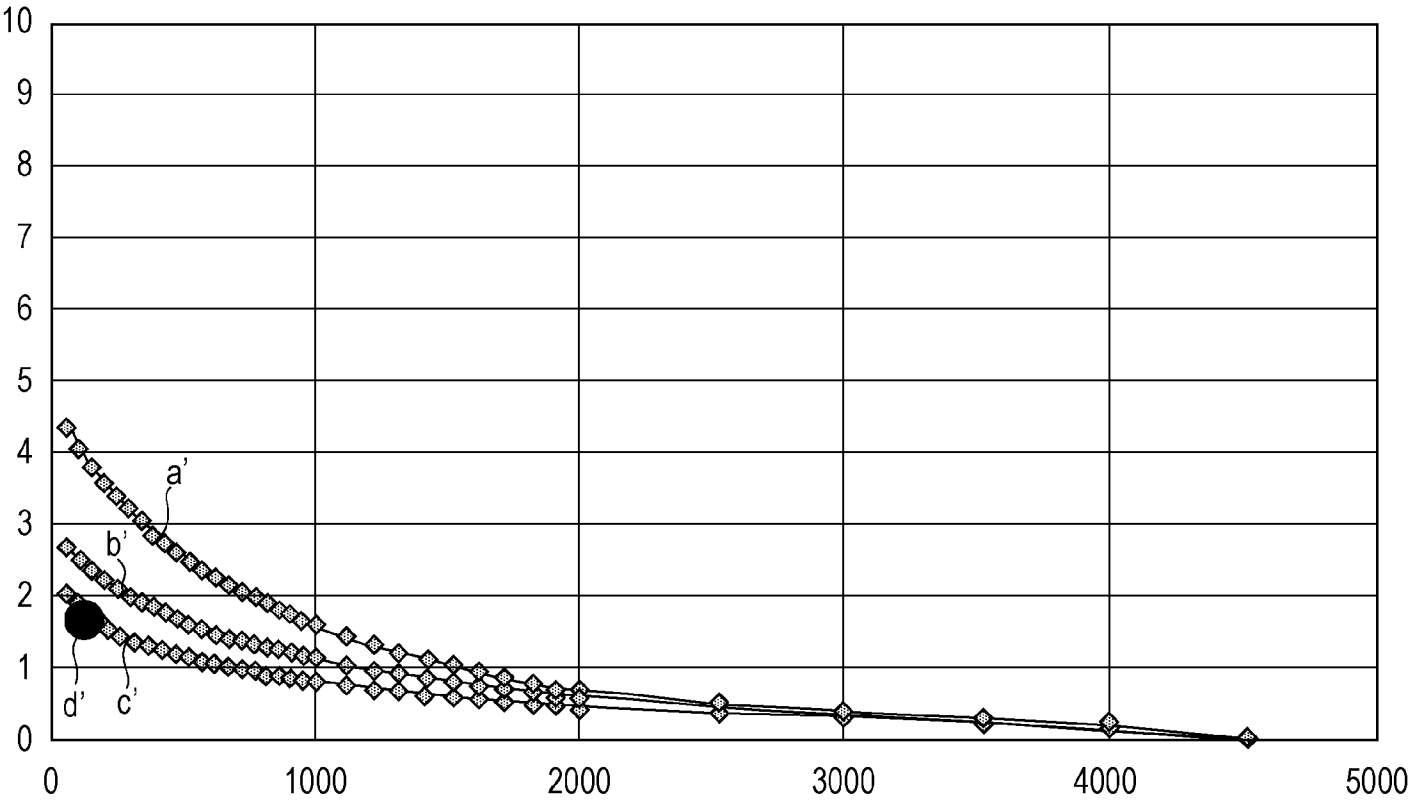
FIG. 15 is a graph depicting predicted values and measured values obtained with the embodiment.

FIGS. 14 and 15 are graphs each depicting the relationship between the inclination angle Y of the independent supply port formed in the bottom surface of the common supply port and the distance X from the edge of the bottom surface to the independent supply port when the process conditions of the ICP etcher are changed. The process conditions of the ICP etcher include, e.g., the RF power value, the process pressure, and the gas flow rate.

FIG. 14 represents the results obtained when the depth of the common supply port is 500 μm, and FIG. 15 represents the results obtained when the depth of the common supply port is 564 μm.

In FIG. 14, a, b and c denote calculated values, and d denotes measured values. The process conditions in the case a are RF power: 3.0 [kW], Bias: [75 W], and pressure: 12 [Pa]. The process conditions in the case b are RF power: 6.0 [kW], Bias: [150 W], and pressure: 12 [Pa]. The process conditions in the case c are RF power: 3.0 [kW], Bias: [150 W], and pressure: 12 [Pa]. The process conditions in the case d are RF power: 3.0 [kW], Bias: [150 W], and pressure: 12 [Pa].

In FIG. 15, a', b' and c' denote calculated values, and d' denotes measured values. The process conditions in the case a' are RF power: 3.0 [kW], Bias: [75 W], and pressure: 12 [Pa]. The process conditions in the case b' are RF power: 6.0 [kW], Bias: [150 W], and pressure: 12 [Pa]. The process conditions in the case c' are RF power: 3.0 [kW], Bias: [150 W], and pressure: 12 [Pa]. The process conditions in the case d' are RF power: 3.0 [kW], Bias: [150 W], and pressure: 12 [Pa].

As seen from FIGS. 14 and 15, there is a tendency that, when the RF power and the bias value are changed to increase an etching rate, the sheath length expressed by the above formula (3) increases and the inclination angle Y increases. Furthermore, taking into consideration, e.g., selectivity with respect to an underlying material, and selectivity with respect to a deposition film on the sidewall when the Bosch process is employed, the relationship between the inclination angle Y and the distance X from the edge of the bottom surface of the common supply port to the center of the independent supply port is expressed by the following formula (5) in a range where an opening of the independent supply port on the same side as the bottom surface of the common supply port and an opening thereof on the same side as the front side of the substrate can be formed at desired accuracy (within ±2.0%):

$$Y=k\{2.0\times10^{-14}\times(X+a)^4-2.0\times10^{-10}\times(X+a)^3+1.0\times10^{-6}\times(X+a)^2-1.8\times10^{-3}\times(X+a)+3.3\times10^{-3}\times h-4.5\times10^{-3}\} \quad (5)$$

In the formula (5), k is a coefficient. As seen from FIGS. 14 and 15, in the range where 0<k<2.5 is satisfied, the opening position of the independent supply port can be predicted using the formula (5) even when taking into consideration the above-mentioned points.

Figure 11:
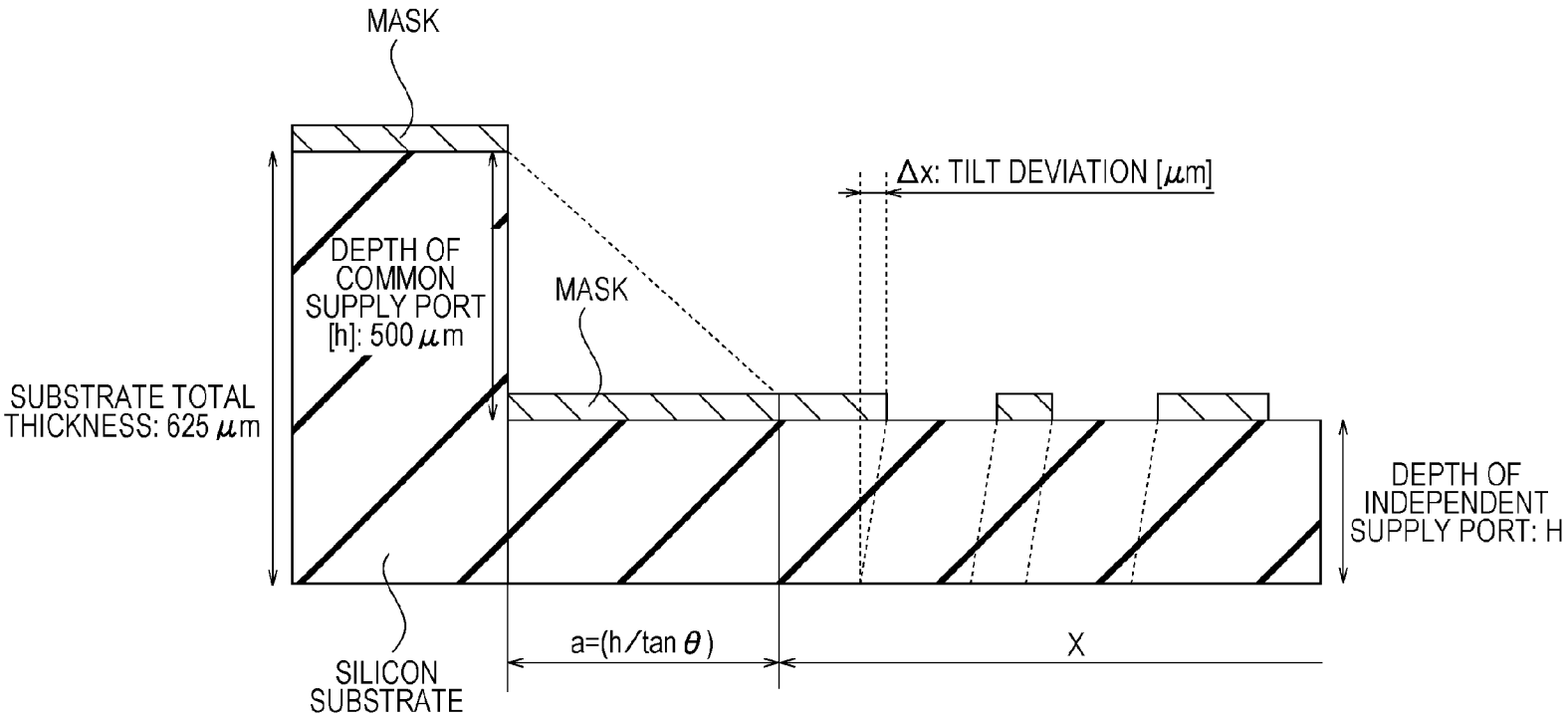
FIG. 11 is a schematic sectional view to explain an example of structure of the substrate in the ink jet recording apparatus head according to the embodiment.
Figure 16:
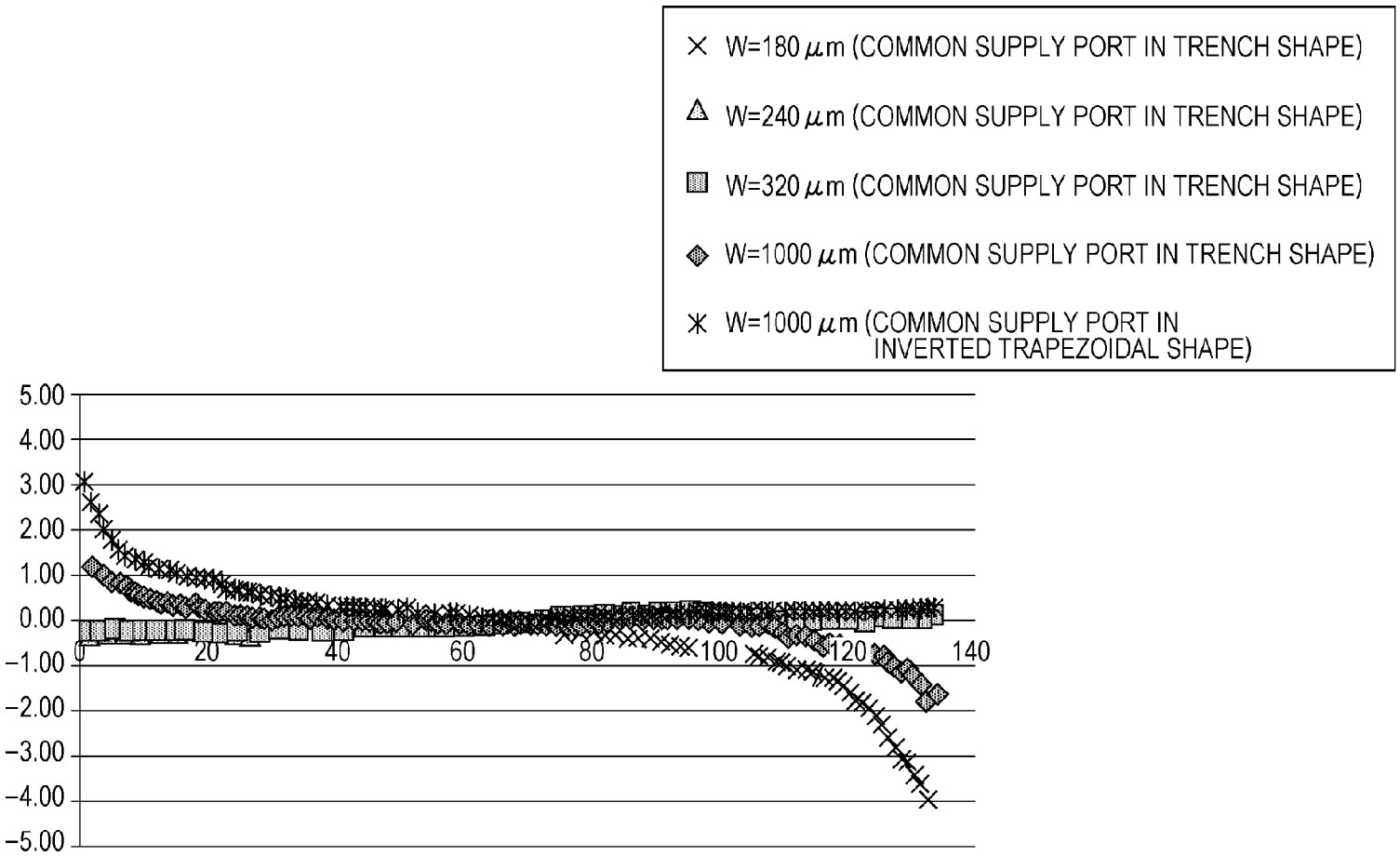
FIG. 16 is a graph depicting predicted values and measured values obtained with the embodiment.

Moreover, the relationship between the shape of the common supply port and the inclination angle of the independent supply port was examined. Regarding the shape of the common supply port, the opening width 808 (see FIG. 8B) of the common supply port was changed to 1.0 mm, 0.32 mm, 0.24 mm, and 0.18 mm, and a trench form having a vertical sidewall, as illustrated in FIG. 11, was employed instead of the form having an inclined sidewall (see FIG. 6A). The opening width 808 of the common supply port implies the width of the common supply port in the widthwise direction thereof, as illustrated in FIG. 8B. FIG. 16 is a graph in which the Y-axis represents the tilt deviation, and the X-axis represents the distance from the edge of the bottom surface of the common supply port to the independent supply port.

As seen from FIG. 16, when the opening width of the common supply port is 0.32 mm or less and a ratio of the opening width to the depth (i.e., an aspect ratio) is 0.64 or less, the distortion of the plasma sheath generated over the substrate surface does not distribute up to the vicinity of the bottom surface of the common supply port. Therefore, the tilting phenomenon of the independent supply port to be formed is reduced. In addition, as seen from FIG. 16, when the shape of the common supply port is changed from the inversed trapezoidal shape in FIG. 6A to the trench shape in FIG. 11, the inclination angle of the independent supply port is reduced. This indicates that the distortion of the plasma sheath, expressed by the above formula (3), at the substrate surface is reduced and curving of ion flux reaching the substrate is also reduced.

Given that the width and the depth of the common supply port are W and h, respectively, when an aspect ratio A (=W/h) is in the range of 0.64<A<3.0 and the width W is in the range of 0.32 mm<W<1.5 mm, the relationship between the inclination angle Y and the distance X from the edge of the bottom surface to the independent supply port is expressed by the following formula (6) based on the formula (5):

$$Y\leq k\{2.0\times10^{-14}\times(X+a)^4-2.0\times10^{-10}\times(X+a)^3+1.0\times10^{-6}\times(X+a)^2-1.8\times10^{-3}\times(X+a)+3.3\times10^{-3}\times h-4.5\times10^{-3}\} \quad (6)$$

In the formula (6), k is a coefficient. In consideration of the above formula (5), it is understood that the formula (6) holds in the range of 0<k<2.5.

As described above, when the opening diameter of the common supply port, the depth of the common supply port, and the distance from the edge of the bottom surface of the common supply port to the center of the opening of the independent supply port are known, the position deviation of the independent supply port can be predicted based on the formulae (1), (5) and (6). Accordingly, the independent supply ports opened at equal intervals or at desired positions can be formed in the substrate surface by forming the independent supply ports with the use of an etching mask that is prepared in consideration of respective predicted deviations of the individual independent supply ports.

First Embodiment

Figure 1B:
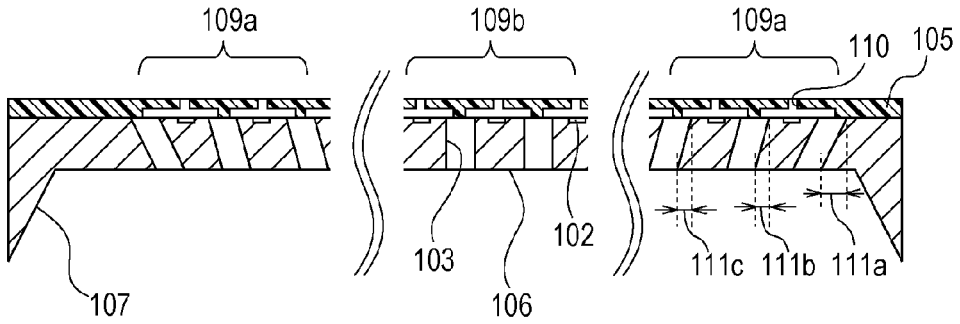

FIGS. 1A and 1B are schematic views of an ink jet recording head according to a first embodiment of the present invention. Specifically, FIG. 1A is a schematic plan view of a substrate.

In FIG. 1A, a group of nozzles positioned in an end portion in the direction of a nozzle array is denoted by 109*a*, and a group of nozzles positioned in a central portion is denoted by 109*b*. In FIG. 1A, a substrate 101 includes, as ejection energy generation elements, a plurality of heating resistors 102 that are arrayed at equal intervals in the direction of the nozzle array (called also the "direction of an ejection orifice array"). The direction of the nozzle array corresponds to a dotted line IB-IB in FIG. 1A. In the ink jet recording head of FIG. 1A, an ejection orifice is provided above the heating resistor 102. A plurality of independent supply ports 103 (having openings on the front surface side of the substrate as illustrated in FIG. 1A) are arranged for each of the heating resistors 102 adjacent thereto in the direction of the nozzle array. In FIG. 1A, numeral 104 denotes a liquid flow passage. Ink is supplied to the liquid flow passage 104 from the independent supply ports 103 and further delivered to the ejection orifice that is formed above the heating resistor 102. Of two adjacent nozzle arrays, one nozzle array is arranged to be shifted from the other nozzle array in the direction of the nozzle array by ¼ of an array interval of the heating resistors 102.

FIG. 1B is a sectional view taken along the dotted line IB-IB in FIG. 1A perpendicularly to a substrate surface. Specifically, FIG. 1B is a schematic sectional view taken along a plane that includes an array of the ejection energy generation elements and an array of the independent supply ports, and that is perpendicular to the substrate surface. In FIG. 1B, an orifice plate (called also a "coating resin layer") 105 including nozzles (called also "ejection orifices") 110 is formed on the front surface side (first surface side) of the substrate 101. Above the heating resistors 102, the nozzles (ejection orifices) 110 are disposed corresponding to the heating resistors 102 in one-to-one relation. The independent supply ports 103 are formed in a bottom surface 106 of a common supply port (called also a "recess") that is formed in the substrate 101. Numeral 107 denotes a sidewall of the recess. An edge of the bottom surface of the common supply port indicates a boundary between the sidewall 107 and the bottom surface 106 of the recess. The independent supply ports 103 are each formed to penetrate from the bottom surface 106 of the common supply port to the front surface of the substrate 101. In the first embodiment, the plural ejection energy generation elements are formed at the same pitch, while the pitch of openings of the independent supply ports 103 in the bottom surface 106 of the common supply port is gradually narrowed toward the edge of the bottom surface 106 of the common supply port from its center.

The common supply port illustrated in FIG. 8A, for example, has a width of 1.0 mm and a depth of 500 μm. The common supply port can be formed by anisotropic wet etching using a strong alkaline solution, e.g., TMAH, up to the depth of 500 μm, for example. When the anisotropic etching is performed on a silicon crystal, an inclination angle 0 between the bottom surface 106 and the sidewall 107 of the common supply port is about 55°. Outermost one of the independent supply ports 103 is formed, for example, at a position away through a distance of about 85 μm from the edge of the bottom surface 106 to a center of the one independent supply port.

Figure 2A:
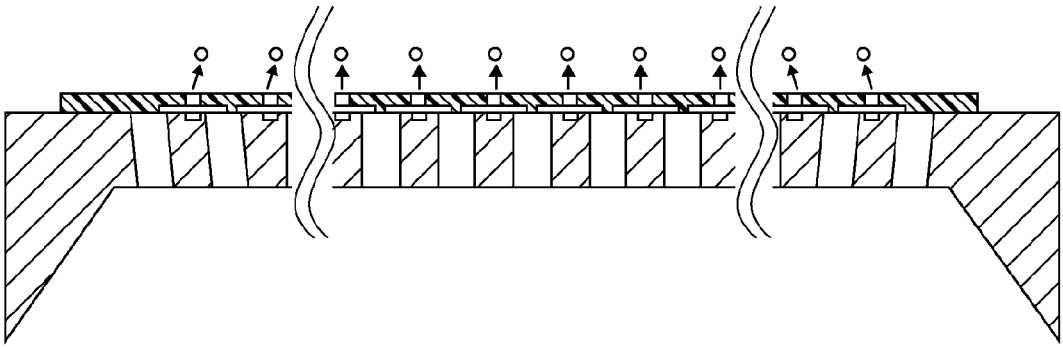
FIGS. 2A and 2B are respectively a schematic sectional view and a schematic plan view to explain an example of structure of an ink jet recording head according to related art.
Figure 2B:
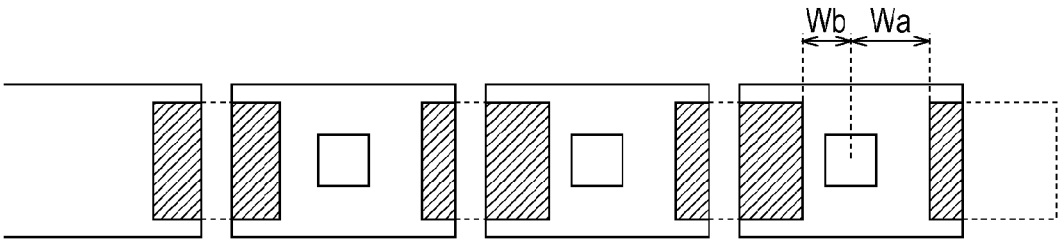

On the other hand, FIGS. 2A and 2B are schematic views of an ink jet recording head as a comparative example. Specifically, FIG. 2A is a schematic sectional view of the ink jet recording head, and FIG. 2B is a schematic plan view of a substrate. In FIGS. 2A and 2B, heating resistors are arrayed as ejection energy generation elements at equal intervals.

In a bottom surface of a common supply port (i.e., a bottom surface of a recess) in FIG. 2A, independent supply ports positioned nearer to an edge of the bottom surface are formed at a larger inclination toward the outside of the substrate. Therefore, when openings (corresponding to positions of the penetrating independent supply ports on the recess side) of an opening pattern in an etching mask, which is formed on the bottom surface of the common supply port to be used in forming the independent supply ports, are formed at equal intervals without taking errors into account, opening positions of the independent supply ports on the front surface side are shifted to a larger extent at positions nearer to the edge of the bottom surface. More specifically, as illustrated in FIG. 2B, looking at two independent supply ports adjacent to the same heating resistor, a difference between distances (Wa and Wb) from a center of the heating resistor to respective opening edges of the two independent supply ports on the first (front) surface side is increased for the independent supply ports that are positioned nearer to a sidewall of the common supply port. As seen from Tables 11, 12, 13, 14 and 15 described above, the position of the independent supply port may deviate bout 5.0 μm, for example. Such a position deviation makes respective flow resistances from the heating resistor to the two independent supply ports adjacent to the relevant heating resistor different from each other. As a result, ink ejected from a pressure chamber provided above the heating resistor is forced to eject obliquely from a direction perpendicular to the substrate surface.

In view of the above-described problem, in the first embodiment, the opening positions of the independent supply ports 103 in the bottom surface 106 of the common supply port are adjusted, as illustrated in FIGS. 1A and 1B, such that respective distances from the heating resistor 102 to the openings of two independent supply ports adjacent thereto on the first surface side are equal to each other, by predicting the opening positions of the independent supply ports on the first surface side based on the above-mentioned formula (1). In other words, the position where the opening of the independent supply port on the first surface side is to be formed can be determined, as described above, using the formula (1) from the distance from the edge of the bottom surface of the common supply port to the independent supply ports. Thus, the opening pattern of the etching mask is formed such that the respective distances from the heating resistor to the openings of two independent supply ports adjacent thereto on the first surface side are equal to each other.

For example, mold members for the liquid flow passages serving as parts communicating with the nozzles (ejection orifices) are disposed on the front surface side of the substrate for the ink jet recording head such that the independent supply ports can be formed starting from a position away by 85 μm from the edge of the bottom surface of the common supply port. The tilt deviation caused by the distortion of the plasma sheath during the processing with the ICP etcher is predicted based on the formula (1), and the etching mask for specifying the opening positions of the independent supply ports on the common supply port side is designed. By forming the independent supply ports with ion etching using plasma while employing the etching mask thus designed, the respective distances from the heating resistor to two independent supply ports adjacent to the heating resistor can be made equal to each other, and the difference in flow resistance therebetween can be reduced. Here, the distance from the ejection energy generation element to the independent supply port implies a distance parallel to the substrate surface, and it is to be a distance from the center of the ejection energy generation element to the opening edge of the independent supply port.

The independent supply ports can be communicated with the nozzles at, e.g., 300 dpi corresponding to the nozzle pitch.

Furthermore, as seen from the formulae (1) and (6), the deviation of the penetrating opening position is as small as negligible for the nozzle group corresponding to the central region of the common supply port. In other words, the opening positions of the independent supply ports are to be adjusted to a larger extent in a region nearer to the sidewall of the common supply port.

As a result, the inclination of the ink ejection direction is reduced and an ink jet recording head can be realized in which recording failures, such as stripes and irregularities, are less noticeable.

Taking as an example an ink jet recording head in which the number of nozzles in one array is 128 and the nozzle interval is 300 dpi, the following description is made about an influence of the difference between the respective distances from the heating resistor to the openings of two independent supply ports adjacent thereto upon a Y deflection when a liquid droplet of 2.8 pl is ejected at 7.5 kHz. The term "Y deflection" implies a deviation of an actual ink landed position from an ideal ink landed position, the deviation being measured as a value in the direction of the nozzle array. A distance between the recording head and a recording medium is 1.25 mm, and a speed of the recording head in the scan direction is 12.5 inch/sec.

In the ink jet recording head illustrated as the comparative example in FIGS. 2A and 2B, the Y deflection is about 8 μm for the nozzle at the outermost end. In that case, the difference between the respective distances from the heating resistor to the positions of the penetrating openings of two adjacent ink supply ports, i.e., the difference between Wa and Wb, is 5 μm at maximum.

On the other hand, the Y deflection in the ink jet recording head according to the first embodiment, illustrated in FIGS. 1A and 1B, is about 2 μm. In the first embodiment, the position where the independent supply port is formed away from the edge of the bottom surface of the common supply port in the silicon substrate is adjusted to be properly shifted from the sidewall of the recess based on the formula (1). It is thus understood that the Y deflection can be reduced by eliminating the difference between the respective distances from the heating resistor to two independent supply ports adjacent to the heating resistor in the front surface of the silicon substrate.

Second Embodiment

Figure 3A:
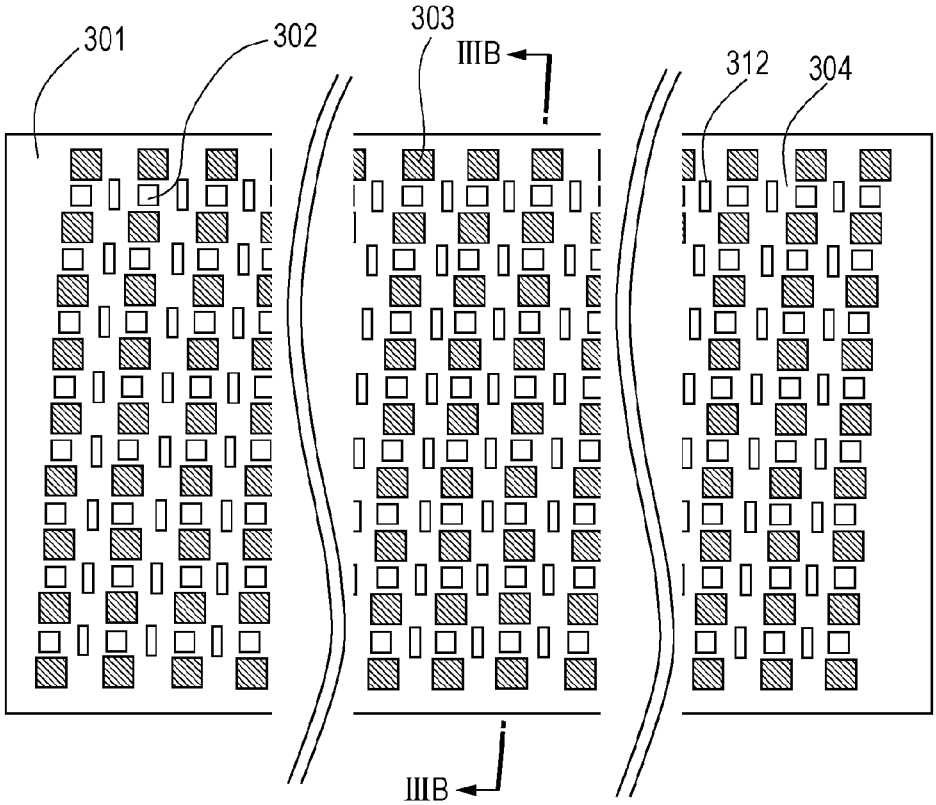
FIGS. 3A and 3B are respectively a schematic plan view and a schematic sectional view to explain an example of structure of an ink jet recording head according to a second embodiment.
Figure 3B:
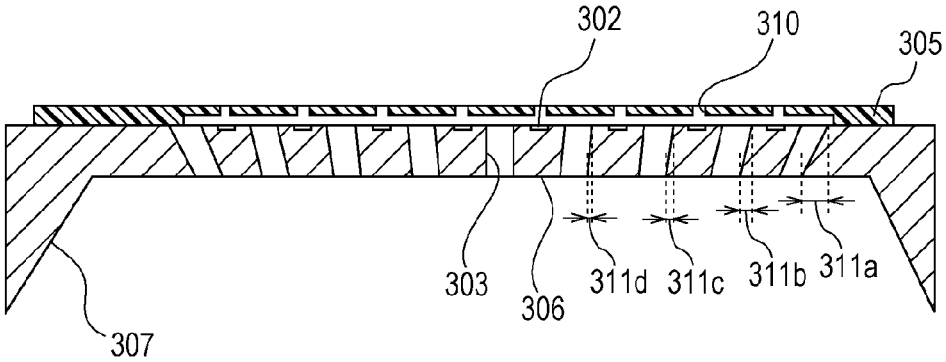

FIGS. 3A and 3B are schematic views of an ink jet recording head according to a second embodiment of the present invention. FIG. 3A is a schematic plan view of a substrate for the ink jet recording head according to the second embodiment, looking at a front surface (first surface) 301 of the substrate. The second embodiment differs from the first embodiment in that plural independent supply ports 303 are arranged adjacent to heating resistors 302 in a direction perpendicular to a nozzle array.

In FIG. 3A, the plural heating resistors 302 are arrayed at equal intervals in the direction of the nozzle array. Two independent supply ports 303 are disposed adjacent to each of the heating resistors 302 for supply of ink to the relevant heating resistor 302. The two independent supply ports 303 are arranged adjacent to the relevant heating resistor 302 in the direction perpendicular to the nozzle array. The heating resistors 302 are each disposed between the two independent supply ports 303. A pressure chamber wall 312 for defining a pressure chamber 304 is formed between the heating resistors 302. In the second embodiment, the pressure chamber 304 serves also as a liquid flow passage. Of two adjacent nozzle arrays, one nozzle array is arranged to be shifted from the other nozzle array in the direction of the nozzle array by ⅛ of an array interval of the heating resistors 302.

In the ink jet recording head of the second embodiment, a common supply port (recess) has an opening width of 1.2 mm and a depth of 600 μm, for example, in the structure illustrated in FIG. 8A. The common supply port can be formed by anisotropic wet etching using a strong alkaline solution, e.g., TMAH, up to the depth of 600 μm. In that case, an inclination angle θ between a bottom surface and a sidewall (inclined surface) of the common supply port is about 55°. The independent supply ports are formed, for example, starting at a position away through a distance of about 100 μm from the edge of the bottom surface of the common supply port.

FIG. 3B is a sectional view taken along a dotted line IIIB-IIIB in FIG. 3A. In FIG. 3B, an orifice plate 305 including nozzles (ejection orifices) 310 is formed on the front surface 301 of the substrate for the ink jet recording head. The independent supply ports 303 are formed in a bottom surface 306 of the common supply port, the bottom surface 306 adjoining with a sidewall 307. The independent supply ports 303 are formed to penetrate through the substrate for the ink jet recording head from the bottom surface 306 of the common supply port.

In the second embodiment, opening positions of the independent supply ports 303 on the front surface side of the substrate are predicted based on the formula (1), and opening positions of the independent supply ports 303 on the rear surface side of the substrate are determined. Thus, the latter opening positions of the independent supply ports 303 are each shifted in accordance with the formula (1) depending on the distance from a recess wall surface that is positioned in the direction perpendicular to the nozzle array.

In FIG. 3B, as seen from the above formulae (4) and (5), the deviations of the opening positions of the ink supply ports in the end-nozzle group are in the relationship of 311*a*>311*b*>311*c*>311*d*. Furthermore, the heating resistors are each formed such that respective distances from the heating resistor to the opening edges of two independent supply ports adjacent thereto on the front surface side of the substrate are equal to each other. Moreover, as seen from the formulae (1) and (6), for the nozzle group near the center of the common supply port, since the deviations of the opening positions of the independent supply ports are as small as negligible, those deviations can be regarded as 0. As a result, the difference between the respective distances from the heating resistor to the two independent supply ports adjacent to the heating resistor can be reduced and the difference in flow resistance therebetween can also be reduced. Hence the inclination of the ink ejection direction is reduced and an ink jet recording head can be provided in which recording failures, such as stripes and irregularities, are less noticeable.

Third Embodiment

Figure 4A:
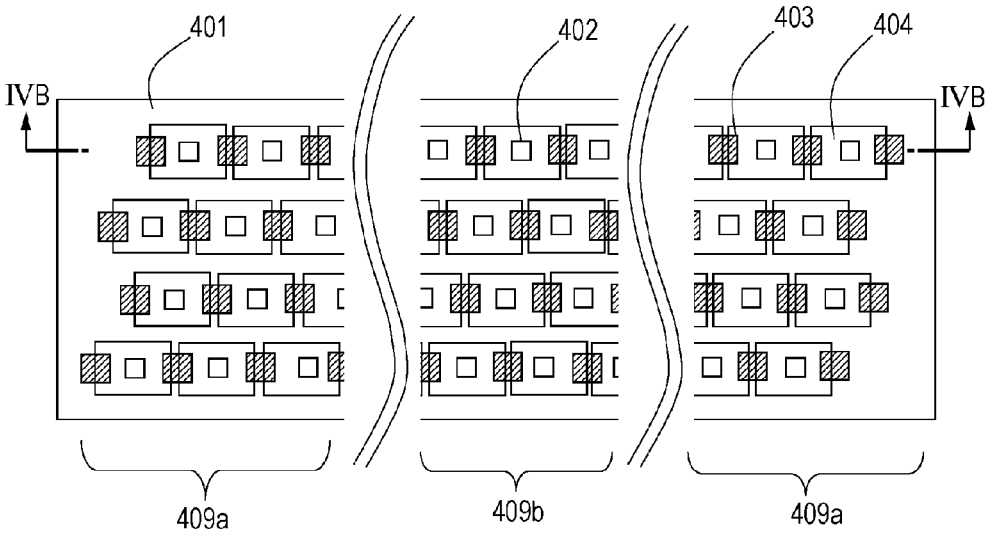
FIGS. 4A and 4B are respectively a schematic plan view and a schematic sectional view to explain an example of structure of an ink jet recording head according to a third embodiment.
Figure 4B:
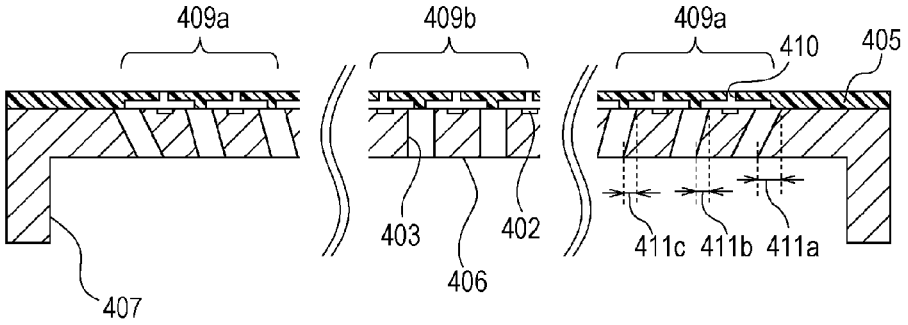

FIGS. 4A and 4B are schematic views of an ink jet recording head according to a third embodiment of the present invention. FIG. 4A is a schematic plan view of a substrate for the ink jet recording head according to the third embodiment, looking at a front surface 401 of the substrate. In FIG. 4A, plural heating resistors 402 are arrayed at equal intervals in the direction of a nozzle array. Two independent supply ports 403 are disposed adjacent to each of the heating resistors 402. In other words, the heating resistors 402 are each disposed between two independent supply ports 403. A pressure chamber 404 serving also as a liquid flow passage is formed in relation to include respective parts of the heating resistor 402 and the independent supply ports 403.

In FIG. 4A, of two adjacent nozzle arrays, one nozzle array is arranged to be shifted from the other nozzle array in the direction of the nozzle array by ¼ of an array interval of the heating resistors 402.

In the ink jet recording head of the third embodiment, a common supply port (recess) has an opening width of 1.0 mm and a depth of 500 μm, for example, in the structure illustrated in FIG. 8A. The common supply port is processed by, e.g., the ICP etcher into a trench shape until reaching the depth of 500 μm. The independent supply ports are formed, for example, starting at a position away through a distance of about 400 μm from the end of a trench-shaped recess. In the case of the trench shape, a value of k has a tendency to reduce.

FIG. 4B is a sectional view taken along a dotted line IVB-IVB in FIG. 4A. In FIG. 4B, an orifice plate 405 including nozzles (ejection orifices) 410 is formed on a front surface 401 of the substrate. The common supply port having the trench shape is defined by a wall surface 407 of the recess in the substrate and a bottom surface 406 of the recess, the bottom surface 406 adjoining with the wall surface 407. The independent supply ports 403 are formed to penetrate through the substrate from the bottom surface of the common supply port (i.e., the bottom surface 406 of the recess) up to the front surface of the substrate.

In the third embodiment, opening positions of the independent supply ports 403 on the front surface side of the substrate are predicted based on the formula (1), and opening positions of the independent supply ports 403 on the rear surface side of the substrate are determined. Thus, as illustrated in FIGS. 4A and 4B, the opening positions of the independent supply ports 403 in the bottom surface 406 of the common supply port are each shifted in accordance with the formula (1) for adjustment depending on the distance from the recess wall surface that is positioned across the direction of the nozzle array. While the distance from the recess wall surface positioned across the direction of the nozzle array (i.e., from the recess wall surface extending in the widthwise direction thereof) is to be taken into account in the third embodiment, embodiments are not limited to such an example. For example, the opening positions of the independent supply ports may be each adjusted in consideration of the distance from the recess wall surface extending in the direction of the nozzle array (i.e., from the recess wall surface positioned across the widthwise direction thereof).

In FIG. 4B, the deviations of the opening positions of the ink supply ports in the end-nozzle group are in the relationship of 411*a*>411*b*>411*c*. Furthermore, the heating resistors are each formed such that respective distances from the heating resistor to the opening edges of two independent supply ports adjacent thereto on the front surface side of the substrate are equal to each other. Moreover, as seen from the formulae (1) and (6), for the nozzle group near the center of the common supply port, since the deviations of the opening positions of the independent supply ports are as small as negligible, those deviations can be regarded as 0. As a result, the difference between the respective distances from the heating resistor to the two independent supply ports adjacent to the heating resistor can be reduced and the difference in flow resistance therebetween can also be reduced. Hence the inclination of the ink ejection direction is reduced and an ink jet recording head can be provided in which recording failures, such as stripes and irregularities, are less noticeable.

Fourth Embodiment

Figure 5A:
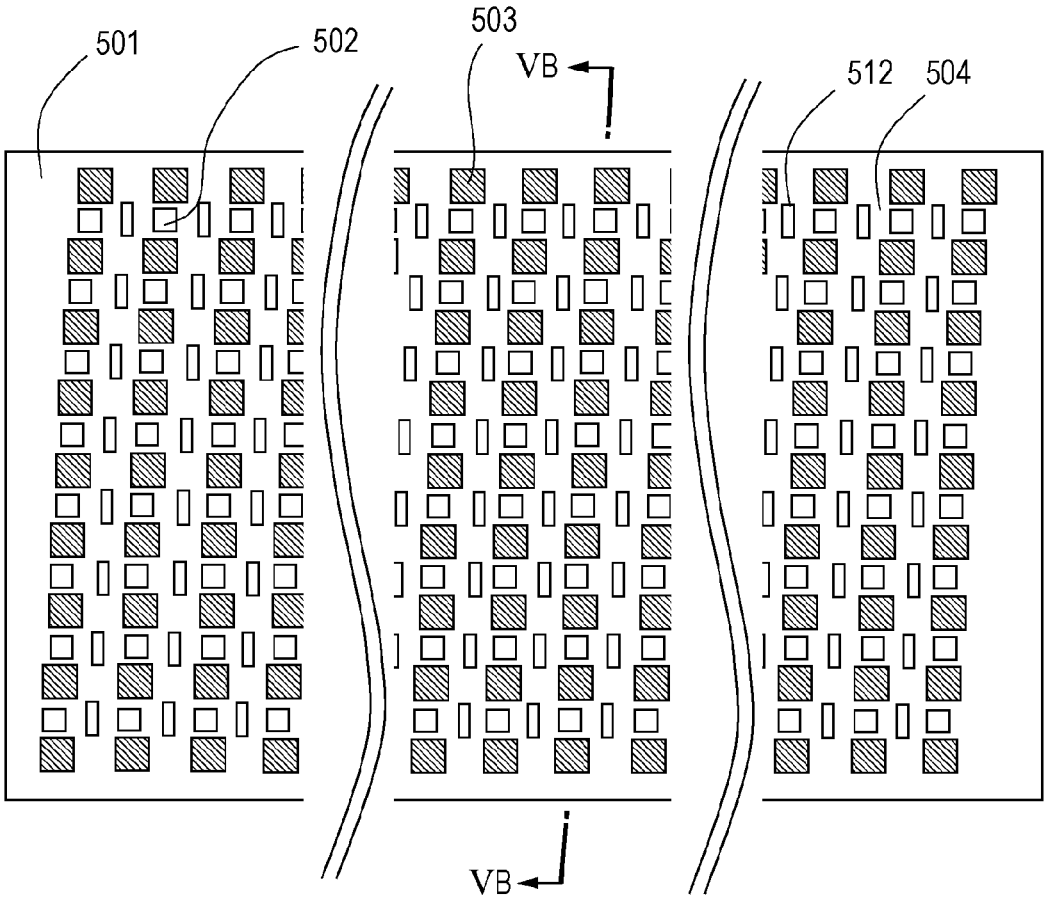
FIGS. 5A and 5B are respectively a schematic plan view and a schematic sectional view to explain an example of structure of an ink jet recording head according to a fourth embodiment.
Figure 5B:
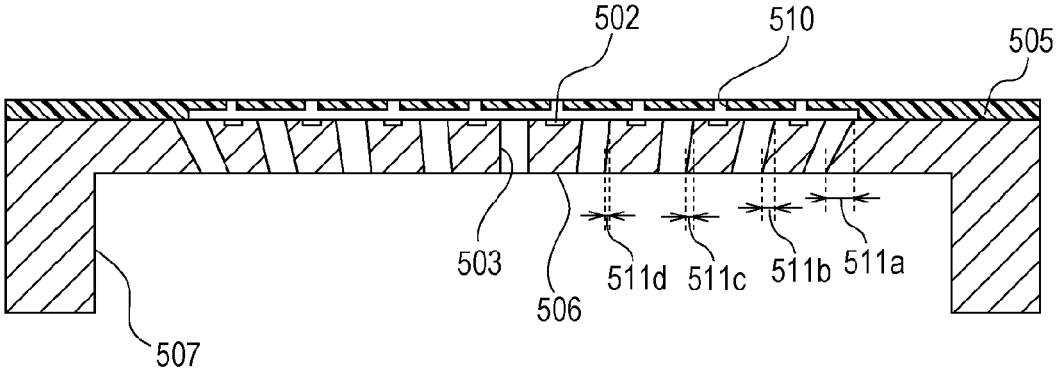

FIGS. 5A and 5B are schematic views of an ink jet recording head according to a fourth embodiment of the present invention. FIG. 5A is a schematic plan view of a substrate for the ink jet recording head according to the third embodiment, looking at a front surface 501 of the substrate.

In FIG. 5A, plural heating resistors 502 are arrayed at equal intervals in the direction of a nozzle array. Two independent supply ports 503 are disposed adjacent to each of the heating resistors 502. In other words, the heating resistors 502 are each disposed between two independent supply ports 503. A pressure chamber wall 512 for defining a pressure chamber 504 is formed between the heating resistors 502. The pressure chamber 504 serves also as a liquid flow passage. Of two adjacent nozzle arrays, one nozzle array is arranged to be shifted from the other nozzle array in the direction of the nozzle array by ⅛ of an array interval of the heating resistors 502.

In the ink jet recording head of the fourth embodiment, a common supply port (recess) has an opening width of 1.2 mm and a depth of 600 μm, for example, in the structure illustrated in FIG. 8A. The common supply port can be processed by, e.g., the ICP etcher into a trench shape until reaching the depth of 600 μm. The independent supply ports are formed, for example, starting at a position away through a distance of about 380 μm from a wall surface 507 of the recess.

FIG. 5B is a schematic sectional view taken along a dotted line VB-VB in FIG. 5A. In FIG. 5B, an orifice plate 505 including nozzles (ejection orifices) 510 is formed on a front surface 501 of the substrate. The common supply port is defined by the wall surface 507 of the recess in the substrate and a bottom surface 506 of the recess, the bottom surface 506 adjoining with the wall surface 507. The independent supply ports 503 are formed to penetrate through the substrate for the ink jet recording head from the bottom surface of the common supply port up to the front surface 501 of the substrate.

In the fourth embodiment, opening positions of the independent supply ports 503 on the front surface side of the substrate are predicted based on the formula (1), and opening positions of the independent supply ports 503 on the rear surface side of the substrate are determined. Thus, the opening positions of the independent supply ports in the bottom surface of the common supply port are each shifted in accordance with the formula (1) depending on the distance from the recess wall surface that is positioned across the direction of the nozzle array.

In FIG. 5B, the deviations of the opening positions of the ink supply ports in the end-nozzle group are in the relationship of 511*a*>511*b*>511*c*>511*d*. Furthermore, the heating resistors are each formed such that respective distances from the heating resistor to the opening edges of two independent supply ports adjacent to the heating resistor on the front surface side of the substrate are equal to each other. Moreover, as seen from the formulae (1) and (6), for the nozzle group near the center of the common supply port, since the deviations of the opening positions of the independent supply ports are as small as negligible, those deviations can be regarded as 0. As a result, the difference between the respective distances from the heating resistor to the two independent supply ports adjacent to the heating resistor can be reduced and the difference in flow resistance therebetween can also be reduced.

Hence the inclination of the ink ejection direction is reduced and an ink jet recording head can be provided in which recording failures, such as stripes and irregularities, are less noticeable.

With the method of manufacturing the liquid ejection head according to the embodiment of the present invention, the deviations of the opening positions of the independent supply ports on the front surface side of the substrate can be reduced. Therefore, the difference between the respective distances from the ejection energy generation element to two independent supply ports adjacent to the ejection energy generation element can be reduced and the difference in flow resistance therebetween can also be reduced. As a result, the inclination of a liquid ejection direction is reduced and a liquid ejection head can be provided in which recording failures, such as stripes and irregularities, are suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-011857 filed Jan. 24, 2012, which is hereby incorporated by reference herein in its entirety.

What is claimed is:

1. A method of manufacturing a liquid ejection head comprising a substrate including, in a first surface thereof, a plurality of ejection energy generation elements configured to generate energy for ejecting a liquid, and an orifice plate disposed on a first surface side of the substrate to form ejection orifice through which the liquid is ejected, and to define liquid flow passages communicating with the ejection orifices, the substrate including a recess-shaped common supply port formed in a second surface thereof on an opposite side to the first surface, and a plurality of independent supply ports penetrating from a bottom surface of the common supply port to the first surface and communicating with the liquid flow passages, the ejection orifices being disposed above the ejection energy generation elements, two of the independent supply ports being disposed adjacent to each of the ejection energy generation elements for supply of the liquid to the relevant ejection energy generation element with the relevant ejection energy generation element disposed between the two independent supply ports, the method comprising the steps of:

(1) forming a recess in the second surface of the substrate to form the common supply port, (2) forming an etching mask having opening patterns which specify opening positions of the independent supply ports, on the bottom surface of the common supply port, and (3) performing ion etching using plasma with the etching mask employed as a mask, thereby forming the independent supply ports, wherein the etching mask has a portion where a pitch of the opening patterns is narrowed toward an edge of the bottom surface of the common supply port from a center of the bottom surface of the common supply port.

2. The method of manufacturing the liquid ejection head according to claim 1, wherein, in a section taken along a plane that passes a center of the ejection energy generation element and respective centers of the two independent supply ports adjacent to the ejection energy generation element, and that is perpendicular to a surface direction of the substrate, one liquid flow passage extending from the ejection energy generation element to one of the two independent supply ports and the other liquid flow passage extending from the ejection energy generation element to the other independent supply port are symmetrical with respect to the ejection energy generation element.

3. The method of manufacturing the liquid ejection head according to claim 1, wherein, when Δx denotes a deviation of an opening of the independent supply port on the bottom surface side of the common supply port relative to the opening of the independent supply port on the first surface side of the substrate, Δx is expressed by a following formula (1);

$$\Delta x = H \times \mathrm{Tan}(\mathrm{RADIANS}(Y)) \tag{1}$$

(H: {(thickness of the substrate)−(depth of the common supply port: h)}, and Y: an angle by which ion flux is curved due to distortion of a plasma sheath when the independent supply port is formed by the ion etching), and a pitch of the opening patterns is adjusted such that there is a portion where the pitch of the opening patterns is narrowed toward the edge of the bottom surface of the common supply port from the center of the bottom surface of the common supply port.

4. The method of manufacturing the liquid ejection head according to claim 1, wherein the angle Y by which the ion flux is curved due to the distortion of the plasma sheath when the independent supply port is formed by the ion etching satisfies a following formula (2):

$$Y \leq k\{2.0 \times 10^{-14} \times (X+a)^4 - 2.0 \times 10^{-10} \times (X+a)^3 + 1.0 \times 10^{-6} \times (X+a)^2 - 1.8 \times 10^{-3} \times (X+a) + 3.3 \times 10^{-3} \times h - 4.5 \times 10^{31\ 3}\} \tag{2}$$

(k: coefficient ($0<k<2.5$), a: distance from an edge of the bottom surface of the common supply port to an opening edge of the common supply port in a direction parallel to the substrate surface, and X: distance from the edge of the bottom surface of the common supply port to the independent supply port).

* * * * *